US005795693A

United States Patent [19]

Okado et al.

[11] Patent Number: 5,795,693

[45] Date of Patent: Aug. 18, 1998

[54] CARRIER FOR ELECTROPHOTOGRAPHY, TWO COMPONENT-TYPE DEVELOPER AND IMAGE FORMING METHOD

[75] Inventors: Kenji Okado, Yokohama; Tsuyoshi Takiguchi, Kawasaki; Tetsuya Ida, Yokohama, all of Japan

[73] Assignee: Canon Kabushiki Kaisha, Tokyo, Japan

[21] Appl. No.: 908,624

[22] Filed: Aug. 8, 1997

Related U.S. Application Data

[63] Continuation of Ser. No. 794,167, Feb. 3, 1997, abandoned, which is a continuation of Ser. No. 491,704, Jun. 19, 1995, abandoned.

[30] Foreign Application Priority Data

Jun. 22, 1994 [JP] Japan ..... 6-162898

[51] Int. Cl.[6] ..... G03G 9/10

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,839,029 | 10/1974 | Berg et al. | 430/106.6 |
| 3,840,464 | 10/1974 | Van Engeland et al. | 252/62.1 |
| 3,849,127 | 11/1974 | Madrid et al. | 96/1 SD |
| 4,040,969 | 8/1977 | Jones | 252/62.1 |
| 4,126,454 | 11/1978 | Jones | 96/15 D |
| 4,282,302 | 8/1981 | Makino et al. | 430/107 |
| 4,592,987 | 6/1986 | Mitsuhashi et al. | 430/102 |
| 4,977,054 | 12/1990 | Honjo et al. | 430/108 |
| 4,985,327 | 1/1991 | Sakashita et al. | 430/106.6 |
| 5,422,216 | 6/1995 | Smith et al. | 430/106.6 |
| 5,466,552 | 11/1995 | Sato et al. | 430/106.6 |
| 5,512,402 | 4/1996 | Kenji Okado | 430/106 |

FOREIGN PATENT DOCUMENTS

| | | |
|---|---|---|
| 0086445 | 8/1983 | European Pat. Off. . |
| 0351712 | 1/1990 | European Pat. Off. . |
| 0424136 | 4/1991 | European Pat. Off. . |
| 0584555 | 3/1994 | European Pat. Off. . |
| 47-13954 | 7/1972 | Japan . |
| 49-70630 | 7/1974 | Japan . |
| 51-3238 | 1/1976 | Japan . |
| 51-3244 | 1/1976 | Japan . |
| 51-3324 | 1/1976 | Japan . |
| 54-72054 | 6/1979 | Japan . |
| 55-65406 | 5/1980 | Japan . |
| 55-127569 | 10/1980 | Japan . |
| 56-32149 | 4/1981 | Japan . |
| 58-23032 | 2/1983 | Japan . |
| 58-123551 | 7/1983 | Japan . |
| 58-129437 | 8/1983 | Japan . |
| 58-144839 | 8/1983 | Japan . |
| 59-111159 | 6/1984 | Japan . |
| 60-208765 | 10/1985 | Japan . |
| 61-204646 | 9/1986 | Japan . |
| 2-877 | 1/1990 | Japan . |
| 2-33159 | 2/1990 | Japan . |
| 2-281280 | 11/1990 | Japan . |
| 60-208767 | 10/1995 | Japan . |

OTHER PUBLICATIONS

Patent Abstracts of Japan, vol. 7, No. 238 (P-231) [1383] of Oct. 22, 1983 for JP-A-58-123548, JP-A-123550.

Patent Abstracts of Japan, vol. 13, No. 211 (C-597) [3559], May 1989 for JPA 1-028234.

*Primary Examiner*—John Goodrow

*Attorney, Agent, or Firm*—Fitzpatrick, Cella, Harper & Scinto

[57] ABSTRACT

A carrier for electrophotography is constituted by magnetic carrier core particles and a resin coating layer coating the magnetic carrier core particles. The carrier core particles contain a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of $Li_2O$, MnO, CaO, SrO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$. The coated carrier particles thus formed exhibit excellent performances in continuous image formation.

130 Claims, 3 Drawing Sheets

CARRIER FOR ELECTROPHOTOGRAPHY, TWO COMPONENT-TYPE DEVELOPER AND IMAGE FORMING METHOD

This application is a continuation, of application Ser. No. 08/794,167, filed Feb. 3, 1997, now abandoned, which, in turn, is a continuation of application Ser. No. 08/491,704 filed Jun. 19, 1995, now abandoned.

FIELD OF THE INVENTION AND RELATED ART

The present invention relates to a carrier constituting a two component-type developer for developing an electrical or magnetic latent image in electrophotography or electrostatic printing, a two component-type developer containing the carrier, and particularly a carrier capable of forming a two component-type developer provided with remarkably improved durability, ability of providing high-quality images and environmental characteristic, such a two component-type developer, and an image forming method using the two component-type developer.

The carrier constituting the two component-type developer may generally be classified roughly into an electroconductive carrier and an insulating carrier.

The electroconductive carrier may generally comprise iron powder or oxidized iron powder. The two component-type developer comprising iron powder carrier is accompanied with problems in that the triboelectric changeability of the toner is liable to be unstable and the resultant visible image formed by the developer is liable to be accompanied by fog. Further, along with continual use of the developer, toner particles adhere onto the surface of the iron powder carrier particles (adhesion of so-called "spent toner" or toner melt-sticking) to increase the electrical resistivity of the carrier particles, so that the bias current decreases and the triboelectric charge is destabilized. As a result, the resultant toner image is liable to have a lower image density and be accompanied by increased fog. Accordingly, when a developer containing iron-powder carrier is continuously used in copying by an electrophotographic copier, the developer is deteriorated after a relatively small number of sheets of copying, so that the developer has to be exchanged in a short period. This consequently results in a high running cost.

The insulating carrier representatively comprises a core material of a ferromagnetic material, such as iron, nickel or ferrite, uniformly coated with an insulating resin. The two component-type developer using this type of carrier is advantageous in that the adhesion of toner particles onto the carrier surface is remarkably less than in the case of the electroconductive carrier, and the developer is excellent in durability and has a long service life, so that the developer is particularly suitable for a high-speed electrophotographic copying machine.

Such an insulating carrier is required to satisfy several requirements including, as particularly important ones: appropriate charge-imparting ability, impact resistance, wear resistance, good adhesion between the core and the coating material and uniform charge distribution.

In view of the above-mentioned various requirements, the insulating carriers used heretofore have still left some room for improvement and are not sufficiently satisfactory as yet. For example, carriers coated with acrylic resins have been disclosed in Japanese Laid-Open Patent Application (JP-A) 47-13954 and JP-A 60-208765. Particularly, JP-A 60-208767, for example, refers to a molecular weight of the coating resin and teaches that an adequate constantly controlled molecular weight will provide a coated carrier having a stable chargeability. The resin coating onto a core material is largely affected by apparatus conditions and environmental conditions, particularly himidity. Even if such conditions are strictly controlled, it has not been sufficient to stably coat the core material with a resin to provide sufficient chargeability and durability.

On the other hand, it has been proposed to use a coating resin having a low surface energy, such as silicone resin, in order to prevent the accumulation of so-called "spent toner", such as toner melt-sticking, and provide an improved durability.

The silicone resin has low surface energy, low surface tension and also has another advantage of high water-repellency. On the other hand, the silicone resin has a low adhesiveness so that a coating layer formed thereof is liable to be peeled off during use.

In order to solve the above problem, there have been proposed use of a resin-modified silicone resin (JP-A 55-127569), a reaction of another resin with vinylsilane previously contained in silicone resin (JP-A 56-32149), use of a mixture of trialkoxysilane and ethyl cellulose (U.S. Pat. No. 3,840,464), and use of a mixture of organosilicone terpolymer and polyphenylene resin (U.S. Pat. No. 3,849,127). These proposals, however, have involved problems such that a high temperature of 300° C. or higher is required for formation of the coating film. Further silicone resin and another resin have poor compatibility with each other to provide a nonuniform coating layer, thus failing to exhibit expected properties.

It has been also proposed to form a coating film at a relatively low hardening temperature (JP-A 55-127569), but the resultant coating film is liable to show an insufficient adhesiveness and an insufficient toughness and is therefore liable to be worn easily. As a result, when the coated carrier is subjected to long hours of intense stirring as in a developing device of a high-speed copying machine, the silicone resin coating layer is liable to be worn or broken to be peeled off due to impingement onto inner walls of the developing device or photosensitive member surface. Consequently, because the triboelectrification mode is changed from one between the toner and the silicone resin to one between the toner and the carrier core, the triboelectric charge of the toner is changed, thus deteriorating the image quality.

Further, in recent years, copying machines capable of providing high-resolution and high-quality image have been increasingly demanded on the market, and it has been attempted to use a smaller particle size of toner for realizing high-quality color images. However, a smaller particle size of toner means a larger surface area per unit weight leading to a large electric charge of toner, which is liable to lower image densities and deterioration in successive image formation performance.

For development of an electrostatic latent image held on an electrostatic latent image-bearing member, toner particles are mixed with larger carrier particles to provide a two component-type developer for electrophotography. The compositions of the toner and the carrier are selected so that the toner is charged to a prescribed polarity, e.g., opposite to that of a charge on the latent image-bearing member, through triboelectrification therebetween. Further, as a result of the triboelectrification, the carrier is caused to carry the toner attached electrostatically to the surface thereof and they are conveyed together as a developer in the developing device to supply the toner onto a latent image on the electrostatic image-bearing member.

However, when such a two component-type developer is used in an electrophotographic copying apparatus for continuous copying on a large number of sheets, clear and good quality of images are formed at an initial stage, but images accompanied with noticeable fog and conspicuous edge effects and also with poor gradation characteristic and clarity are liable to result after copying on several tens of thousands of sheets.

In color copying using a chromatic color toner, a continuous gradation characteristic is an important factor affecting the image quality, and the occurrence of an edge effect which provides selective enhancement of an image peripheral portion after a large number of copies remarkably impairs the gradation characteristic of an image. Further, the edge effect can produce a false contrast in the neighborhood of a true contour, thus impairing the copying reproducibility including color reproducibility in color copying.

Further, in comparison with a monochromatic copy image having an image area of 10% or lower and comprising mostly line images as in letters, documents and reports, color copy images occupy an image area of at least 20% and frequently comprise solid images having a gradation as in photographs, catalogues, maps and paintings.

When continuous copying is performed by using an original having such a large image area, copies having a high image density can be obtained at an initial stage. However, toner replenishment to the two component-type developer cannot keep up with the gradual consumption, thus being liable to result in a density decrease, a mixture of replenished toner and carrier in an insufficiently charged state causing fog, and a local increase or decrease in toner concentration (i.e., a toner content in the developer) on the developing sleeve leading to scratchy images or ununiform image densities. This tendency is more pronounced when the toner size is made smaller.

These difficulties of insufficient development and occurrence of fog may be attributable to too low a toner content in the two component-type developer (i.e., toner concentration) or a slow increase in triboelectrification between the replenished toner and the carrier in the two component-type developer, leading to participation of a toner having an insufficiently controlled charge in development.

A color developer is required to show an ability of continuously providing good quality of images in continuous reproduction of an original having a large image area as an indispersable performance. Conventionally, in order to cope with problems encountered in reproduction of an original having a large image area and thus causing a large toner consumption rate, an improvement in the developing device has been resorted to in many cases rather than an improvement in the developer per se. For example, the peripheral speed or the diameter of a developing sleeve is increased so as to increase the opportunity of contact between the electrostatic latent image and the developing sleeve.

The above measures can increase the developing capacity but are accompanied with difficulties, such as soiling in the apparatus due to toner scattering from the developing device and a shortening of apparatus life due to an overload on the developing device. In some cases, a larger amount of developer may be charged in a developing device in order to supplement an insufficient developing ability of the developer, but this is not so desirable either because it also results in an increase in weight of the whole apparatus, an increased production cost due to size enlargement of the apparatus and also an overload on the developing device similarly as above.

For the above reason, improvements in both toner and carrier have been examined and reported in order to provide a high image quality for a long period.

Heretofore, several developers have been proposed in order to provide improved image quality. For example, JP-A 51-3244 has proposed a non-magnetic toner having a controlled particle size distribution so as to improve the image quality. The toner principally comprises particles having a size of 8–12 μm and is therefore relatively coarse. According to our study, it is difficult for a toner having such an particle size to effect a intimate "coverage" of a latent image. Further, the toner has a rather broad particle size distribution including at most 30% by number of particles having a size of at most 5 μm and at most 5% by number of particles of at least 20 μm. In order to form a clear image by using such a relatively coarse toner having a broad particle size distribution, it is necessary to superpose toner particles in a large thickness so as to fill gaps between toner particles and provide an apparently increased image density. As a result, an increased amount of the toner is consumed in order to provide a prescribed image.

JP-A 54-72054 has proposed a non-magnetic toner having a narrower particle size distribution. However, the toner includes particles of 8.5–11.0 μm as a medium size and has left room for improvement in order to provide a high resolution.

JP-A 58-129437 has proposed a non-magnetic toner having an average particle size of 6–10 μm and a mode particle size of 5–8 μm. The toner however contains particles of at most 5 μm in a small percentage of at most 15% by number and thus tends to provide an image with insufficient sharpness.

According to our study, it has been found that toner particles of at most 5 μm principally have functions of clearly reproducing the contour of a latent image and intimately covering the whole latent image. Particularly, in the case of an electrostatic latent image on a photosensitive member, the contour (edge) of the latent image shows a higher electric field intensity than the interior due to concentration of electrical lines of force, so that the clearness or sharpness of an image is determined by the quality of toner particles gathering at the contours. According to our study, it has been found that a substantial amount of particles of 5 μm or smaller is effective in solving the problem concerning image sharpness.

As a result, we have proposed a toner containing toner particles of at most 5 μm in a proportion of 15–40% by number (JP-A 2-222966). As a result, a substantial improvement in image quality has been realized, but a further improvement in image quality has been desired.

JP-A 2-877 has proposed a toner containing toner particles of at most 5 μm in 15–60% by number. The toner has actually provided stable image quality and image density. However, it has been also found difficult to stably provide images of a constant quality by an improvement in toner alone because a toner particle size distribution can change in case where an original requiring a large toner consumption, such as a photographic image, is continuously reproduced.

On the other hand, certain particle sizes and distribution thereof have been suggested in JP-A 51-3238, JP-A 58-144839 and JP-A 61-204646. Among these, JP-A 51-3238 roughly refers to a particle size distribution but does not refer to magnetic properties closely related with the developing performance and conveyability in a developing device of a developer. The carriers used in the Examples all contain about 80 wt. % or more of over 250 mesh and have an average particle size of at least 60 μm.

JP-A 58-144839 simply refers to an average particle size of a carrier and does not refer to the amount of a fine powder fraction affecting the carrier attachment onto a photosensitive member or a coarse powder fraction affecting the sharpness of a resultant image. Further, the carrier particle size distribution has not been considered in view of color copying characteristics.

JP-A 61-204646 discloses a combination of a copying apparatus and an appropriate developer as an essential characteristic but does not refer to a particle size distribution and magnetic properties of a carrier. Further, it has not been clarified why the developer is effective for the copying apparatus.

JP-A 49-70630 describes the magnetic force of a carrier comprising iron powder having a larger specific gravity than ferrite and also a high saturation magnetization. Iron powder carrier has been frequently used heretofore but is liable to result in an increase in copying apparatus weight and an excessively large drive torque. Further, its performance is liable to change depending on environmental conditions.

JP-A 58-23032 discloses a porous ferrite carrier, which is liable to cause an edge effect and have a poor continuous image forming performance, thus being unsuitable as a carrier for color image formation.

Ferrite carriers containing MgO have been disclosed in, e.g., JP-A 59-111159, JP-A 58-123551 and JP-A 55-65406. However, the particle size distributions of these ferrite carriers are not particularly controlled. A combination of these ferrite carriers with a toner of 1–9 μm would not provide a two component-type developer having satisfactory charging stability and successive image forming characteristic.

JP-A 2-33159 contains a disclosure that MgO can be contained but no disclosure is made regarding a positive inclusion of MgO for improving the surface-modifying effect thereof to provide an improved durability of a resin coating layer in combination with a controlled particle size distribution.

Heretofore, there has been desired a developer that can continuously reproduce an image having a large image area in a small amount and satisfies properties peculiarly suitable for color copying, such as freeness from the edge effect even after a continuous copying. Developers and carriers have been studied, but most of them have been proposed for monochromatic copying, and few have been proposed as being also applicable to full color-reproduction. Further, it has been desired to provide a carrier capable of continuously reproducing an almost solid image having an image area of 20% or higher, alleviating the edge effect, and retaining a uniformity of image density in one copy sheet.

JP-A 2-281280 has provided a carrier having improved developing performances characterized by having a narrow particle size distribution with controlled amounts of fine powder and coarse powder fractions.

As described hereinbefore, however a demand for a copying machine satisfying a high resolution and a high image quality has been increased in the market and, for this purpose, a smaller particle size of toner has been tried also for accomplishing a high-quality color image formation. A smaller particle size of toner has an increased surface area per unit weight and tends to have a larger electric charge, which is liable to provide a lower image density and a deterioration in continuous image formation characteristic.

In order to prevent such a lowering in image density and deterioration in continuous image forming characteristic and also to provide an increase in developing performance, attempts have been made to use a carrier having a further smaller particle size. Such a carrier, however, does not provide sufficient qualities suitably copins with changes in toner chargeability depending on environmental conditions and continuation of successive image formation. Accordingly, it has been difficult to provide a high image density, high image quality, good fog-prevention characteristic and good carrier attachment-prevention characteristic using such a carrier.

SUMMARY OF THE INVENTION

A generic object of the present invention is to provide a two component-type developer and a carrier therefore having solved the above-mentioned problems.

A more specific object of the present invention is to provide a two component-type developer and a carrier therefor free from a lowering in image density and formation of scratchy images even in continuous copying of a color original having a large image area.

A further object of the present invention is to provide a two component-type developer and a carrier therefor capable of providing clear images free from fog and excellent in successive image forming performance.

Another object of the present invention is to provide a two component-type developer and a carrier therefor providing a quick triboelectrification between the toner and carrier.

Another object of the present invention is to provide a two component-type developer and a carrier therefor with little dependence on change in environmental conditions in triboelectrification performance.

Still another object of the present invention is to provide a two component-type developer and a carrier therefor having a good conveying performance in a developing device.

A further object of the present invention is to provide an image forming method using such a two component-type developer as described above.

According to the present invention, there is provided a carrier for electrophotography, comprising: magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of $Li_2O$, MnO, CaO, SrO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$.

According to another aspect of the present invention, there is provided a two component-type developer, comprising: a toner comprising toner particles, and the above-mentioned carrier.

According to still another aspect of the present invention, there is provided an image forming method, comprising:

circulatively conveying the above-mentioned two component-type developer comprising a toner and a carrier on a developer-carrying member, and developing, in a developing region, an electrostatic latent image held on an electrostatic image-bearing member with the toner in the two component-type developer.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
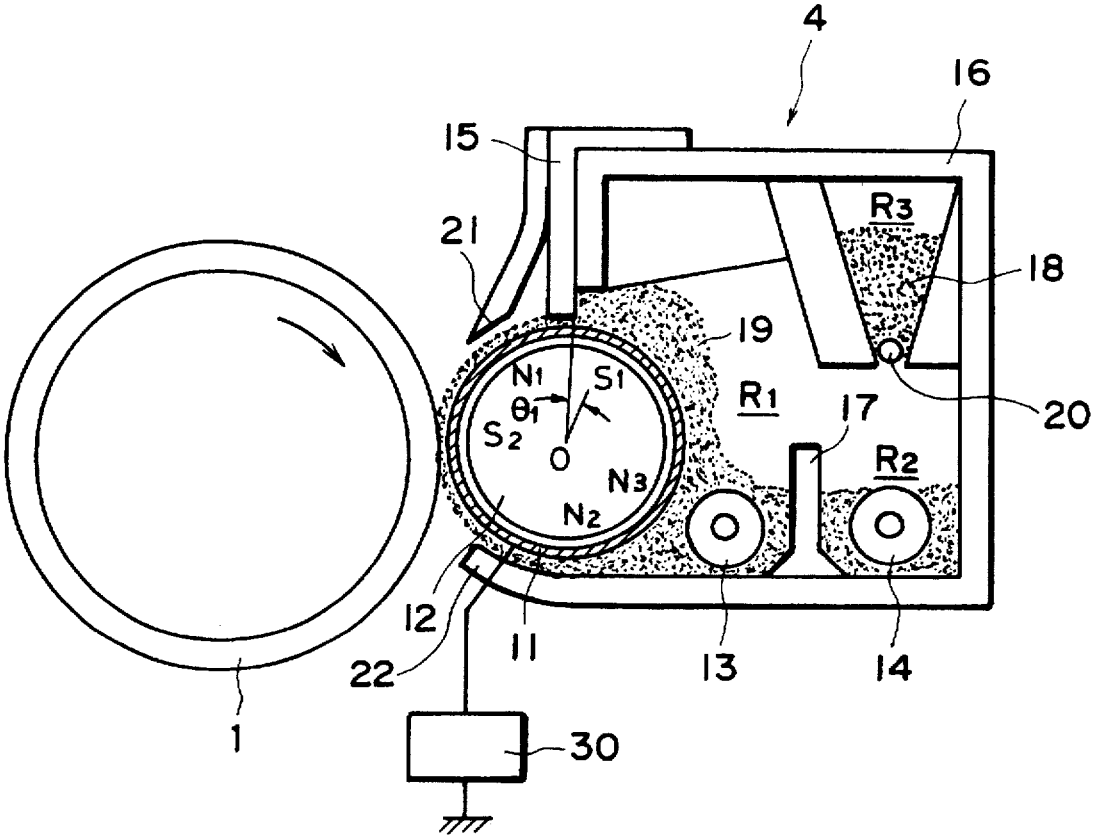
FIG. 1 is a schematic illustration of an image forming apparatus suitable for performing an embodiment of the image forming method according to the invention.

As a result of our study for solving the above-mentioned problems, it has been found effective to use a carrier comprising magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of $Li_2O$, MnO, CaO, SrO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$.

In the formula (I), it is further preferred that x, y and z further satisfy: $x+y<1$ and $z=1-x-y$, so as to provide carrier core particles having a moderate surface roughness, an appropriate moisture content, adhesiveness to a resin and toughness. It is however possible that the ferrite component can contain preferably at most 3 wt. % of another metal element in the form of a hydroxide, oxide, sulfide or aliphatic acid compound for various proposes, such as control of surface crystal grain size, prevention of coalescence during calcination, and control of particle size distribution. Accordingly, $x+y+z<1$ in the formula (I) means the case where the ferrite component contains such another optional component in an amount of preferably up to 3 wt. %. A specific example of the case will be found in Example 4 appearing hereinafter.

In the above formula (I), if x is below 0.2, the carrier is liable to have a low magnetic property leading to carrier scattering and damage the surface of the photosensitive member. In case where x is above 0.95, the core is liable to have a low resistivity. If y is below 0.005, it is difficult to obtain proper resistivity and magnetic properties. If y is above 0.3, it becomes difficult to form spherical carrier core particles having a uniform surface. If z is 0, i.e., no B component is contained, it becomes difficult to provide a sharp particle size distribution, resulting in ultra-fine particles which are liable to damage the photosensitive member surface and make difficult the carrier production due to severe coalescence during the calcination. If z exceeds 0.795, the core is caused to have low magnetic properties leading to carrier scattering.

In the above formula (I), it is further preferred that x, y and z satisfy the following conditions::

$0.4 \leqq x \leqq 0.9$, $0.01 \leqq y \leqq 0.25$, $0.001 \leqq z \leqq 0.2$.

Among the B components of $Li_2O$, MnO, CaO, SrO $Al_2O_3$ and $SiO_2$, it is preferred to use MnO, CaO, $SiO_2$ and $Al_2O_3$ because of little decrease in resistivity under a high-voltage application, and particularly MnO and CaO in view of good compatibility with a replenished toner.

The carrier core particles comprising the ferrite component represented by the above formula (I) are coated with a layer of resin, which may preferably comprise a reactive resin containing a specific curing agent.

Heretofore, it has been proposed to use a modified silicone resin in order to provide an increased adhesiveness with the carrier core particles. The modification may be with alkyd, epoxy, acryl, polyester, phenol, melamine or urethane. However, such a modified silicone resin is caused to have an increased surface energy and is liable to cause toner sticking, so that it is not satisfactory in respect of successive image forming characteristic of the resultant developer.

It has been proposed to use various additives so as to increase the adhesiveness while retaining a low surface energy (JP-A 2-33159).

These additives are reacted with a silicone resin or by itself to impart an adhesiveness and a toughness. The modified silicone resin disclosed by JP-A 2-33159 actually provides a coating resin having an improved durability but does not provide sufficiently satisfactory adhesiveness with the carrier core particles when it is formed as a thin coating layer onto the surface of the carrier core particles. A further improvement is therefore desired.

As a result of further study of ours, it has been found possible to provide a long-life carrier having high performances inclusive of good adhesiveness and chargeability if magnetic carrier core particles containing a metal oxide having a solubility of 0.5–10 mg/100 ml, preferably 0.5–2 mg/100 ml, in water at 25° C. are coated with a reactive silicone resin, preferably one containing a curing agent represented by a formula (III) appearing hereinafter, preferably an aminosilane coupling agent, through an appropriate degree of reaction between some moisture contained in the carrier core particles and remaining reactive group in the silicone resin.

JP-A 2-33159 also discloses a silicone resin containing a curing agent represented by the formula (III) appearing hereinafter, but the above-described method is different therefrom in that a metal oxide having a specific solubility is caused to be contained in a specific amount in the magnetic carrier core particles and is reacted with such a reactive silicone resin. As a result, it is possible to provide a carrier with an enhanced strength between the carrier core particles and the resin coating layer.

The magnetic carrier core particles suitably used in the present invention may comprise MgO having a solubility of 0.62 mg/100 ml or $Ag_2O$ having a solubility of 1.74 mg/100 ml, respectively in water at 25° C. It is further preferred to use ferrite particles containing 0.5–30 wt. % (as oxide) of MgO in view of stability of resistivity, surface uniformization, easiness of spherization, and an appropriate moisture content of the ferrite particles.

The coated carrier according to the present invention may also be characterized by a specific surface property and a particle size distribution.

More specifically, as a result of our study, a two component-type developer providing high image qualities inclusive of high image density, good highlight reproducibility and good thin-line reproducibility can be realized by using a carrier having specific particle size distribution and surface property.

The carrier (particularly, core particles thereof) according to the present invention may be characterized by a uniformly small particle size carrier having a small average particle size and controlled contents of fine and coarse powder fractions and having a certain degree of surface unevenness. Accordingly, even when the core particles are coated with a resin having a small free energy, the resultant coated carrier retains a good toner-conveying performance and is provided with a quick triboelectrification characteristic.

The carrier may preferably have a 50%-particle size (volume-basis median particle size, i.e., a particle size at which a cumulative particle size fraction (from the smallest measurable particle size) reaches 50% by volume) of 15–60 μm, preferably 20–45 μm, and contains 1–20 wt. %, desirably 2–15 wt. %, more preferably 4–12 wt. %, of carrier particles of below 22 μm, including 0.01–3 wt. %, preferably 0.01–2 wt. %, more preferably 0.01–1 wt. %, of carrier particles of below 16 μm.

If the content of the fine powder fraction (below 22 μm) exceeds the above-mentioned upper limit, the carrier core particles cannot be stably coated with a resin, and the resultant carrier is liable to cause carrier attachment and prevent smooth charging of the toner. If the carrier particles of below 22 μm is below 1 wt. %, only sparse magnetic brush can be formed to provide a slow initial charging rate of the toner, thus causing toner scattering and fog.

Carrier particles of 62 μm or larger are closely related with the sharpness of the resultant images and may preferably be contained in 2–20 wt. %. Above 20 wt. %, the toner-conveying performance of the carrier is lowered and the toner scattering onto non-image parts is increased to lower the image resolution and the highlight reproducibility. Below 2 wt. %, the flowability of the resultant two component-type developer is lowered to cause localization of the developer in the developing device, so that it becomes difficult to form stable images.

The carrier according to the present invention may preferably have a specific area ratio $S_1/S_2$ of 1.2–2.0, more preferably 1.3–1.8, further preferably 1.4–1.7, wherein $S_1$ represents a specific surface area measured by the air permeation method (described in detail hereinafter) and $S_2$ denotes a specific surface area calculated by the following formula (II):

$$S_2=[6/(\rho\times D_{50})]\times 10^4 \quad \text{(II)},$$

wherein ρ denotes a density and $D_{50}$ denotes a 50%-particle size, respectively, of a sample carrier.

If the ratio $S_1/S_2$ is below 1.2, the carrier surface becomes smooth and this means a lower adhesiveness of the resin coating layer onto the carrier core particles, resulting in toner scattering, fog or image irregularity. If the ratio $S_1/S_2$ exceeds 2.0, the carrier surface becomes excessively uneven, thus being liable to provide a nonuniform resin coating layer on the carrier core particles. As a result, the uniformity of charging is impaired, thus being liable to result in fog, toner scattering, and carrier attachment.

In order to enhance the effect of the present invention, the carrier may preferably have an apparent density of 1.2–3.2 g/cm$^3$, more preferably 1.5–2.8 g/cm$^3$. If the apparent density is below the above described range, the carrier attachment is liable to occur. Above the above-described range, the circulatability of the resultant two component-type developer becomes worse, the toner scattering is liable to occur, and the image quality degradation is accelerated.

In order to promote the effect of the present invention, the carrier may preferably show a current value (as measured by a method described hereinafter) of 20–300 μA, more preferably 30–250 μA, further preferably 40–200 μA.

If the current value is below 20 μA, the charge migration on the carrier surface may not be effectively performed and the carrier is caused to have a lower charge-imparting ability to the toner, thus being liable to cause fog and toner scattering. Above 300 μA, the carrier attachment onto the photosensitive member and the leakage of a bias voltage are liable to occur, thus being liable to result in image defects.

The magnetic performances of a carrier are affected by a magnet roller contained in a developing sleeve and, in turn, greatly affect the developing performance and the conveyability of the two component-type developer.

In an embodiment of the image forming method according to the present invention, a developing sleeve (developer-carrying member) containing a magnet roller therein is rotated while the magnetic roller is fixed, thereby circulatively conveying a two component-type developer comprising the magnetic carrier and an insulating color toner to develop an electrostatic latent image held on the electrostatic image-bearing member. In this instance, preferred conditions may include (1) the magnet roller having 5 magnetic poles including a repulsive magnetic pole, (2) a magnetic flux of 50–1200 gauss in the developing region, and (3) a saturation magnetization of the carrier of 20–70 Am$^2$/kg, so as to provide excellent image uniformity and gradation reproducibility in color image formation.

If the carrier has a saturation magnetization exceeding 70 Am$^2$/kg (under an applied magnetic field of 3000 oersted), the resultant brush or ear composed of the carrier and the toner on the developing sleeve opposite an electrostatic latent image on the photosensitive member becomes tightly packed, thus providing a lower reproducibility of gradation and halftone. Below 20 Am$^2$/kg, it becomes difficult to well hold the toner and the carrier on the developing sleeve, thus being liable to cause carrier attachment and toner scattering.

The curing agent contained in the reactive particle size may suitably be an oxime-type curing agent represented by the following formula (III):

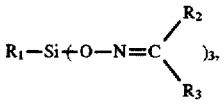

(III)

wherein $R_1$ denotes a substituent selected from the group consisting of $CH_3$, $C_2H_5$ and

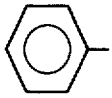

each capable of having a substituent; and $R_2$ and $R_3$ independently denote $CH_3$ and $C_2H_5$ each capable of having a substituent. Thus, such an oxime-type silane coupling agent is suitable in view of an appropriate degree of control of remaining reactive groups in the silicone resin, storage stability and inexpensiveness.

As coupling agents having a high reactivity, there have been known acetic acid-type (acetoxysilane) and acetone-type (propenoxysilane). By using these coupling agents, however, it is somewhat difficult to set reaction conditions for effecting a stable reaction between the carrier core particles and the silicone resin to leave some reactive groups so that these coupling agents are less advantageous in view of the production stability.

Specifically preferred examples of the curing agent may include those represented by the following formulae (1)–(4):

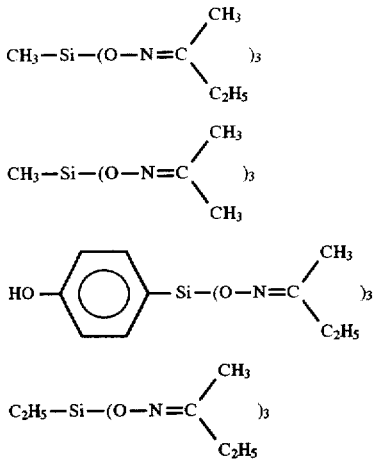

(1)

(2)

(3)

(4)

The above-mentioned curing agent may preferably be added in a proportion of 0.1–10 wt. parts, more preferably 0.5–5 wt. parts, per 100 wt. parts of the siloxane resin (solid matter). Below 0.1 wt. part, a sufficient crosslinking effect cannot be attained. Above 10 wt. parts, the residue thereof can remain because of insufficient reaction or insufficient removal of the residue, thus being liable to impair the charging characteristic and the mechanical strength.

Another class of the curing agent suitably contained in the reactive silicone resin may be an aminosilane coupling agent, specific examples of which may include those represented by the following formulae (5)–(13):

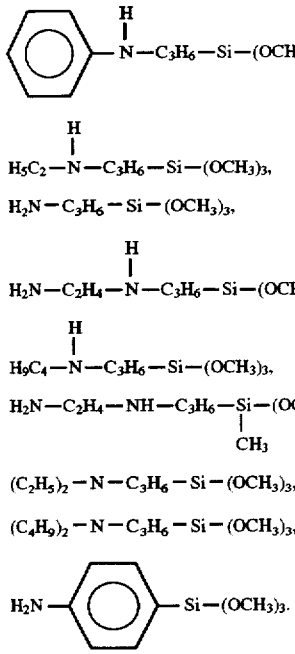

(5)

(6)

(7)

(8)

(9)

(10)

(11)

(12)

(13)

These aminosilane coupling agents may be used singly or in combination of two or more species (or in combination with the above-mentioned oxime-type coupling agent). Among the above, aminosilane coupling agents including a nitrogen atom having one hydrogen atom bonded thereto (i.e., an imino group) as represented by those shown below are particularly suitable in view of mutual solublity, reactivity and stability.

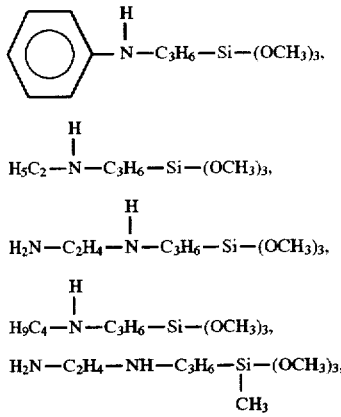

(5)

(6)

(8)

(9)

(10)

These aminosilane coupling agents may preferably be added in a proportion of 0.1–8 wt. parts, more preferably 0.3–5 wt. parts, per 100 wt. parts of the siloxane resin (solid matter). Below 0.1 wt. part, a sufficient effect of addition cannot be attained. In excess of 8 wt. parts, a sufficient reaction may not be effected thus being liable to lower the coating layer strength.

Another class of the coupling agent additionally usable in the present invention may include those represented by the following formula (IV):

$$R_{4-a}—Si—X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3. These coupling agents may be used in combination with the above-mentioned oxime-type silane coupling agent or aminosilane coupling agent. Specific examples of this class of coupling agents may include those represented by the following formulae (14)–(16):

$$CH_3{=}CH—Si—(OCH_3)_3, \quad (14)$$

$$CH_3—Si—(OCH_3)_3, \text{ and} \quad (15)$$

$$CH_3—Si—(OC_2H_5)_3. \quad (16)$$

The magnetic carrier core particles may be coated with a resin according to various methods, including a method wherein a coating resin composition is dissolved in an appropriate solvent and, into the resultant solution, the carrier core particles are dipped and taken up therefrom, followed by solvent removal, drying and baking at an elevated temperature; a method wherein the carrier core particles are fluidized in a fluidizing system and a solution of the coating resin composition is sprayed thereonto for coating, followed by drying and baking at an elevated temperature; and a method wherein the carrier core particles are simply blended with powder or an aqueous emulsion of the coating resin composition.

In a preferred method, a mixture solvent formed by adding 0.1–5 wt. parts, preferably 0.3–3 wt. parts, of water to a solvent containing at least 5 wt. %, preferably at least 20 wt. %, of a polar solvent, such as ketone or alcohol, may be used so as to intimately attach a coating resin, such as a reactive silicone resin, onto the carrier core particles. In case where the water is below 0.1 wt. part, the hydrolysis of the reactive silicone resin is not sufficiently effected so that it is difficult to form a thin and uniform coating film onto the surface of the carrier core particles. In excess of 5 wt. parts, the reaction control becomes difficult, thus providing a rather low coating strength.

In the present invention, the carrier and a toner are blended to prepare a two component-type developer in a mixing ratio which preferably provides a toner concentration in the developer of 1–12 wt. %, more preferably 2–9 wt. %, so as to provide generally good results. If the toner concentration is below 1 wt. %, the resultant image density is lowered. In excess of 12 wt. %, fog and toner scattering in the apparatus are liable to occur, thus shortening the life of the developer.

A first preferred mode of the toner blended with the carrier to provide a two component-type developer according to the present invention may comprise toner particles and an external additive of surface-treated inorganic fine particles preferably having a weight-average particle size of 0.001–0.2 μm. The toner may have a weight-average particle size of 1–9 μm. (Incidentally, a toner including toner particles and an external additive may be subjected to a particle size measurement. However, the weight-average particle size of the toner is generally governed by the toner particles, since the external additive has a particle size which is generally below the lower limit of the toner particle size measurement.)

The inorganic fine powder as an external additive may for example comprise alumina, titanium oxide or silica. Among these, alumina or titanium oxide fine particles may preferably be used so as to further stabilize the toner chargeability.

It is further preferred to hydrophobize (i.e., impart hydrophobicity to) the inorganic fine powder in order to reduce the dependency of the toner chargeability on environmental conditions, such as temperature and humidity, and also to prevent the isolation thereof from the surface of the toner particles. Examples of the hydrophobizing agent may include coupling agents, such as silane coupling agents, titanium coupling agents and aluminum coupling agents; and oils, such as silicone oil, fluorine-containing oils and various modified oils. Among the above-mentioned hydrophobizing agents, the coupling agent is particularly preferred in view of the stabilization of toner chargeability and the flowability-imparting effect.

Consequently, the external additive particularly preferably used in the present invention may comprise alumina or titanium oxide fine particles surface-treated with a coupling agent while being hydrolyzed in view of the stabilization of the toner chargeability and the fluidity imparting effect.

The hydrophobized inorganic fine powder may preferably have a hydrophobicity of 20–80%, more preferably 40–80%. If the hydrophobicity below 20 %, the chargeability is liable to be remarkably lowered when the toner is left standing for a long period in a high-humidity environment, so that a charging promotion mechanism may be required in the apparatus, thus complicating the apparatus. If the hydrophobicity exceeds 80%, the charging control of the inorganic fine powder per se becomes difficult, thus resulting in a toner charge-up (i.e., an excessive toner charge) in a low-humidity environment.

The hydrophobized inorganic fine powder may preferably have a weight-average particle size of 0.001–0.2 μm, more preferably 0.005–0.15 μm in view of the flowability-imparting effect and the prevention of isolation from the toner surface.

If the weight-average particle size is below 0.001 μm, the inorganic fine powder is liable to be embedded at the surface of the toner particles, thus rather lowering the successive image forming characteristic due to the toner deterioration. In excess of 0.2 μm, an improved toner flowability cannot be attained, thus being liable to result a nonuniform toner charge leading to toner scattering and fog.

The hydrophobized inorganic fine powder may preferably show a light transmittance (as measured according to a method described hereinafter) of at least 40% at wavelength of 400 nm.

The inorganic fine powder, even though having a small primary particle size, is not necessarily present in the form of primary particles but can be present in the form of secondary particles when it is actually contained in the toner. Accordingly, even if the primary particle size is sufficiently small, the inorganic fine powder can provide a lower transmittance if it has a large effective particle size as a result of behavior as secondary particles. On the other hand, an inorganic fine powder having a higher optical transmittance at a lower limit wavelength in the visible region of 400 nm shows a smaller secondary particle size, thus providing excellent performances with respects to flowability-imparting ability and clearness of projected images in the case of a color toner. The wavelength of 400 nm is a boundary between the ultraviolet and visible regions. Further, particles having a particle size which is equal to or shorter than the wavelength of an objective light are known to substantially transmit the objective light, so that light having a longer wavelength shows a larger transmittance and has a lower value as a reference light. This is why the light having a wavelength of 400 nm is used as a reference light.

The toner used in the present invention may preferably have a weight-average particle size of 1–9 μm, more preferably 2–8 μm, so as to provide a good harmonization of high image quality and high successive image forming performance.

If the weight-average particle size is below 1 μm, the mixability with the carrier is lowered to result in defects, such as toner scattering and fog. In excess of 9 μm, the accomplishment of a high image quality is hindered due to a lowering in minute dot-reproducibility or scattering at the time of transfer.

The toner used in the present invention may contain a colorant which may be a known dye and/or pigment, examples of which may include: Phthalocyanine Blue, Indanthrene Blue, Peacock Blue, Permanent Red, Lake Red, Rhodamine Lake, Hansa Yellow, Permanent Yellow, and Benzidine Yellow. The colorant may be added in an amount of 12 wt. parts or less, more preferably 0.5–9 wt. parts, per 100 wt. parts of the binder resin, so as to provide a good sensitivity to transmittance of an OHP film.

The toner used in the present invention can contain an additive within an extent of not impairing the toner characteristic. Examples of such an additive may include: a lubricant, such as polytetrafluoroethylene, zinc stearate, or polyvinylidene fluoride; a fixing aid, such as low-molecular weight polyethylene or low-molecular weight polypropylene; and organic resin particles.

The toner may be produced through various processes including a process wherein starting ingredients are melt-kneaded in a hot kneading means, such as hot rollers, a kneader or an extruder, and the kneaded and cooled product is mechanically pulverized and classified; a process wherein toner materials, such as a colorant, are dispersed in a binder resin solution and then the resultant dispersion are spray-dried; and a process wherein prescribed materials such as a colorant are dispersed in a polymerizable monomer providing a polymer constituting the binder resin to provide a polymerizable mixture, and the resultant polymerizable mixture is dispersed in suspension or emulsion to be polymerized.

The binder constituting the toner may comprise various resins, examples of which may include: polystyrene; styrene-copolymers, such as, styrene-butadiene copolymer, styrene-acrylic copolymer; polyethylene, ethylene copolymers, such as ethylene-vinyl acetate copolymer; and ethylene-vinyl alcohol copolymer; phenolic resins, epoxy resins, allyl phthalate resin, polyamide resins, polyester resin, and maleic acid resin.

Any of these resins produced through any production processes may be used.

The present invention is most suitably applied to a toner obtained from a polyester resin having a high negative chargeability. A polyester resin has an excellent fixability, is suitable for a color toner but, on the other hand, is liable to be charged excessively because of a strong negative chargeability. However, this difficulty is alleviated when combined with the carrier according to the present invention.

It is particularly preferred to use a polyester resin formed by condensation copolymerization between a diol component comprising a bisphenol derivative represented by the following formula (V) or a substituted derivative thereof and a carboxylic acid component comprising a carboxylic acid having two or more carboxylic groups or an anhydride thereof, such as fumaric acid, maleic acid, maleic anhydride, phthalic acid, terephthalic acid, trimellitic acid and pyromellitic acid:

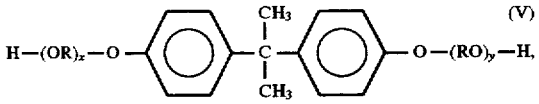

(V)

wherein R denotes an ethylene or propylene group, x and y are independently a positive integer of at least 1 with the proviso that the average of x+y is in the range of 2–10. This type of polyester resin is preferred because of a sharp melting characteristic.

Thus, a second preferred mode of toner used in the present invention may have a weight-average particle size of 1–9 μm, comprise toner particles containing a binder resin comprising a polyester resin and have an acid value of 1–20 mgKOH/g, preferably 2–18 mgKOH/g, further preferably 3–15 mgKOH/g.

More specifically, if the above-described toner having an acid value of 1–20 mgKOH/g is used in combination with the carrier of the present invention comprising the above-mentioned specific ferrite component coated with a resin coating layer, the charging stability is improved to allow quick charging, thereby providing a two component-type developer which is free from fog or toner scattering for a long period even when an original having a high image area ratio is used.

In case where the acid value is below 1 mgKOH/g, the initial charging speed is lowered, thus being liable to result in severer fog. On the other hand, if the acid value exceeds 20 mgKOH/g, the chargeability in a high humidity environment is liable to be lowered, thus resulting in fog and toner scattering.

In order to provide a toner having an acid value in the range of 1–20 mgKOH/g, the acid component for providing the binder resin may preferably contain 0.1–20 mol. %, more preferably 0.1–10 mol. %, of polyvalent carboxylic acid having at least three functional groups. It is further preferred that the toner comprising a polyester resin as a binder resin may preferably have a glass transition temperature (Tg) in the range of 45°–70° C. and a temperature giving an apparent viscosity of $10_5$ poises (Tm) in the range of 80°–120° C. A preferred class of the polyester resin is the above-described polyester resin formed from the bisphenol represented by the formula (V).

The polyester resin can be used in mixture with another resin, examples of which may include those enumerated in the first preferred mode of toner used in the present invention.

The toner particles may be blended with external additives, as desired, examples of which may include those enumerated in the first preferred mode of toner used in the present invention.

Now, an embodiment of the image forming method according to the present invention using a two component-type developer as described above will now be described.

In the image forming method according to the present invention, a two component-type developer comprising a toner and a carrier is circulatively conveyed on a developer-carrying member and, in a developing region, an electrostatic latent image held on an electrostatic image-bearing member is developed with the toner in the two component-type developer carried on the developer carrying member.

In the image forming method according to the present invention, it is preferred to effect the development under application of a developing bias in the developing region.

A particularly preferred developing bias voltage will now be described. More specifically, in the present invention, it is preferred to apply a developing bias comprising a succession of voltages including a first voltage directing a toner from the image-bearing member toward the developer-carrying member, a second voltage directing the toner from the developer carrying member toward the image-bearing member and a third voltage intermediate between the first and second voltages. It is further preferred that a period ($T_1$) for applying the first voltage and the second voltage is set to be shorter than a period ($T_2$) for applying the third voltage so as to cause an rearrangement of the toner on the image-bearing member for faithful development of the latent image.

More specifically, the first voltage (i.e., one forming an electric field for directing the toner from the image-bearing member toward the developer-carrying member) and the second voltage (i.e., one forming an electric field for directing the toner from the developer-carrying member toward the image-bearing member) are applied for at least one cycle (once each), and then the third voltage (for establishing an electric field for directing the toner from the developer-carrying member toward the image-bearing member at an image part on the image-bearing member and for directing the toner from the image-bearing member toward the developer-carrying member) is applied for a prescribed period, thereby to develop the latent image on the image-bearing member with the toner in the two component-type developer. In this instance, the time ($T_2$) for applying the third voltage is preferably set to be longer than the total time ($T_1$) for applying the first and second voltages.

The above-mentioned application of the first to third voltages may be performed simply by a sequence of applying an alternating electric field (applying the first and second voltages) and turning off the alternating electric field (applying the third voltage). This sequence may be repeated periodically.

The application of the first to third voltages is effective for preventing carrier attachment. The mechanism thereof has not been fully clarified as yet but may be reasoned as follows.

According to the application of a conventional continuous sine waveform or alternating rectangular waveform, when the electric field is intensified in order to accomplish a high image quality and density, the toner and the carrier integrally move reciprocally between the image-bearing member and the developer-carrying member, whereby the image-bearing member is intensely rubbed with the carrier to cause carrier attachment. This tendency is conspicuous when a large fine powder carrier fraction is present.

On the other hand, when the above-mentioned specific alternating electric field is applied, the toner or carrier causes a reciprocal movement such that it does not complete the reciprocation between the developer-carrying member and the image-bearing member within one cycle of the alternating electric field. As a result, during the application of the third voltage thereafter, in case where a potential difference Vcont between the surface potential of the image-bearing member and the DC component of the developing bias (third voltage) satisfies Vcont<0, Vcont functions to direct the carrier from the developer-carrying member toward the image-bearing member, but the movement of the carrier causing carrier attachment in this case can be prevented by adequate control of the magnetic properties of the carrier and the magnetic flux in the developing region exerted by the magnet roller. On the other hand, in case of Vcont>0, Vcont and the magnetic field force both function to pull the carrier toward the developer-carrying member. As a result, the carrier attachment (onto the image-bearing member) may be effectively prevented.

A preferred form of the electrostatic image-bearing member suitably used in an embodiment of the image forming method according to the present invention will now be described with reference to FIG. 6.

Figure 6:
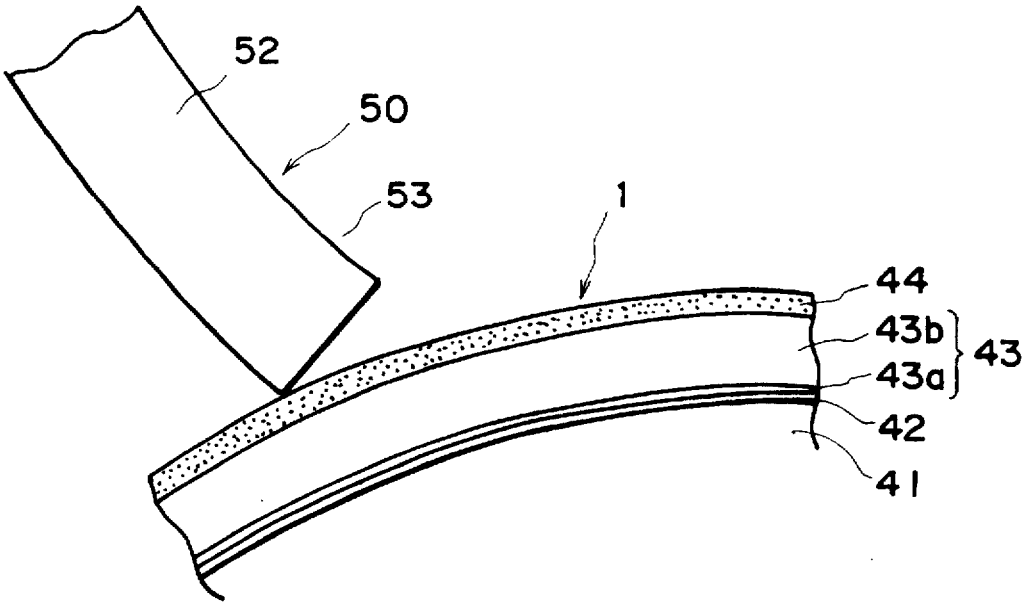
FIG. 6 is a partial illustration of an electrostatic image-bearing member suitably used in an embodiment of the image forming method according to the invention.

Referring to FIG. 6, an electrostatic latent image-bearing member 1 comprises a photosensitive layer 43 and a protective layer 44 disposed on an electroconductive support 41. At least the protective layer 44 contains fluorine-containing resin particles so as to reduce a surface frictional resistance of the image-bearing member 1. The protective layer 44 may preferably be mechanically abraded to provide a ten point-average surface roughness Rz according to JIS B061 (hereinafter simply called "average surface roughness") of 0.01–1.5 μm.

If the average surface roughness is within the above range, the friction between a cleaning blade 50 and the image-bearing member 1 is sufficiently small and, even on repetitive use, no image defects appear thereby. Further, an excellent highlight reproducibility can be attained.

The content of the fluorine-containing resin particles added for effectively lowering the surface frictional coefficient of the image-bearing member 1 may be 5–40 wt. %, preferably 10–40 wt. %, of the total weight of the protective layer 44. The protective layer may preferably have a thickness of 0.05–8.0 μm, more preferably 0.1–6.0 μm.

In case where the photosensitive layer 43 also contains the fluorine-containing resin particles, the content of the particles may be reduced as the photosensitive layer 43 is thicker than the protective layer 44. More specifically, the content in the photosensitive layer may preferably be at most 10 wt. %, more preferably at most 7 wt. %.

Even if the content of the fluorine-containing resin particles in the photosensitive layer is reduced, remarkable decreases in sensitivity and uniformity of images can occur due to light scattering in case where the total thickness of the photosensitive layer 43 is large and particularly when photocarriers are principally generated at a support side of the photosensitive layer 43. Too small a thickness of the photosensitive layer 43 can cause a decrease in sensitivity and a decrease in chargeability due to an electric capacity increase of the photosensitive layer 43. Further, even in case where no such particles are contained in the photosensitive layer, an extremely large photosensitive layer thickness is not desirable. This is because the protective layer 44 containing the particles disposed on the photosensitive layer 43 functions as a light-scattering layer. Particularly, in case where photocarriers are generated in a support side of the photosensitive layer, the influence of the light scattering is increased if the site of photocarrier generation is remoter from the light scattering layer, i.e., if the photosensitive layer is thicker, to provide an increased light path length after the scattering.

Accordingly, the total thickness of the photosensitive layer 43 and the protective layer 44 may preferably be 10–35 μm, more preferably 15–30 μm. A smaller content of the fine particles in the photosensitive layer 43 is preferred. Accordingly, the average content of the fine particles in the photosensitive layer 43 and the protective layer 44 may preferably be at most 17.5 wt. % based on the total weight of these layers.

The fluorine-containing resin particles used in the image-bearing member 1 may comprise one or more species selected from polytetrafluoroethylene, polychlorotrifluoroethylene, polyvinylidene fluoride, polydichlorodifluoroethylene, tetrafluoroethylene-perfluoroalkyl vinyl ether copolymer, tetrafluoroethylene, tetrafluoroethylene-hexafluoropropylene copolymer, tetrafluoroethylene-ethylene copolymer and tetrafluoroethylene-hexafluoropropylene-perfluoroalkyl vinyl ether copolymer. Commercially available fluorine-containing resin particles can be used as they are. The fluorine-containing resin may have a molecular weight of $0.3\times10^4$–$5\times10^6$. The particle size may be 0.01–10 μm, preferably 0.05–2.0 μm.

The photosensitive layer 43 may contain organic photoconductive substances including a charge generation substance and a charge transportation substance.

Examples of the charge generation substance may include: phthalocyanine pigments, polycyclic quinone pigments, trisazo pigments, disazo pigments, azo pigments, perylene pigments, indigo pigments, quinacridone pigments, azulenium pigments, squarilium dyes, thiopyryllium dyes, xanthene dyes, quinoneimine dyes, triphenylmethane dyes, styryl dyes, selenium, selenium-tellurium alloy, amorphous silicon, and cadmium sulfide.

Examples of the charge transportation substance may include; pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, and pendant polymers formed by fixing these compounds on polymers.

In many cases, the fluorine-containing resin particles, the charge generation substance, and the charge transportation substance are dispersed or contained in the respective film-forming binder resins. Examples of the binder resins may include: polyester, polyurethane, polyacrylate, polyethylene, polystyrene, polybutadiene, polycarbonate, polyamide, polypropylene, polyimide, phenolic resin, acrylic resin, silicone resin, epoxy resin, urea resin, allyl resin, alkyd resin, polyamide-imide, nylon, polysulfone, polyallyl ether, polyacetal and butyral resin.

The electroconductive support may comprise metals, such as iron, copper, gold, silver, aluminum, zinc, titanium, lead, nickel, tin, antimony and indium; alloys of these metals; or oxides of these metals; carbons, and electroconductive polymers. The support may have a shape of drum of a tube or pillar; a belt, or a sheet. The electroconductive material may be molded as it is, applied as a coating, vapor-deposited, or worked by etching or plasma treatment. The coating may be formed on a support of a metal or alloy as described above, paper or plastic.

The photosensitive layer 43 may comprise a single layer or a laminate layer structure. The laminate layer structure may comprise at least a charge generation layer 43*a* and a charge transport layer 43*b*. The charge generation layer 43*a* or the charge transport layer 43*b* (as shown in FIG. 6) may be disposed closer to the electroconductive support. Depending on whether either one of these is adopted, the charging polarity and the polarity of toner charge are changed. The charge generation layer 43*a* may preferably have a thickness of 0.001–6 μm, more preferably 0.01–2 μm. The charge generation substance may comprise 10–100 wt. %, preferably 50–100 wt. %, thereof of a charge generation substance. The charge transport layer 43*b* may have a thickness which is equal to a subtraction of the charge generation layer thickness from the above-mentioned photosensitive layer thickness. The charge transport layer may preferably contain the charge transportation substance in 20–80 wt. %, more preferably 30–70 wt. %.

It is possible to dispose an undercoating layer 42 between the electroconductive support 41 and the photosensitive layer 43. The undercoating layer 42 may have a function of charge injection control or function as an adhesive layer. The undercoating layer 42 may principally comprise a binder resin but can further contain a metal or alloy, or an oxide of these, a salt, or a surfactant. The binder resin may comprise a resin selected from those resins for the photosensitive layer 43. The undercoating layer may have a thickness of 0.05–7 μm, preferably 0.1–2 μm.

The protective layer may be disposed on the photosensitive layer as described above and may preferably comprise at least resin particles containing a high concentration of fluorine atoms and a binder resin.

The image-bearing member may be produced through various processes including vapor deposition and/or coating. By the coating, it is possible to form various compositions of films in a widely varying thickness. Examples of the coating method may include those using bar coater or knife coater, dipping, spray coating, beam coating, electrostatic coating, roller coating, attritor and powder coating.

The coating composition for providing the protective layer may be formed by dispersing the fluorine-containing resin particles in a mixture of a binder and a solvent. The dispersion may be performed by using a ball mill, ultrasonic disperser, a paint shaker, a red devil, or a sand mill. Similar dispersion methods may be adopted for dispersion of electroconductive powder and pigments inclusive of a pigment as a charge generation substance.

An image forming apparatus suitably used for practicing an embodiment of the image forming method according to the present invention will now be described with reference to FIG. 1.

Referring to FIG. 1, an image forming apparatus includes a photosensitive drum 1 as an electrostatic image-bearing member, and a developing device 4 which in turn includes a developing vessel 16. The interior of the developing vessel 16 is divided by a partitioning wall into a developing chamber (first chamber) $R_1$ and a stirring chamber (second chamber) $R_2$, above which a toner storage chamber $R_3$ is formed. In the developing chamber $R_1$ and the stirring chamber $R_2$, a developer 19 is stored and, in the toner storage chamber $R_3$, a replenishing toner (non-magnetic toner) 18 is contained. The toner storage chamber $R_3$ is provided with a replenishing hole 20, through which the replenishing toner 18 is dropped and supplied in an amount corresponding to a consumed amount.

Inside the developing chamber, a conveying screw 13 is provided and rotated to convey the developer 19 in the developing chamber $R_1$ along a longitudinal direction of developer sleeve 11. Similarly, in the stirring chamber $R_2$, a conveying screw 14 is disposed and rotated to convey the toner dropped through the replenishing hole 20 in a direction parallel to the longitudinal direction of the developing sleeve.

The developer 19 is a two component-type developer comprising a non-magnetic toner and a magnetic carrier. Adjacent the photosensitive drum 1, the developing vessel 16 is provided with an opening, through which the developing sleeve 11 is projected so as to form a gap from the photosensitive drum 1. The developing sleeve 11 comprises a non-magnetic material and is provided with a bias application means 30.

A magnetic roller 12 as a magnetic field generating means is disposed inside the developing sleeve 11 and provided with 5 magnetic poles including a developing pole $S_2$, a magnetic pole $N_2$ disposed downstream of $S_1$, and magnetic poles $N_3$, $S_1$ and $N_1$ for conveying the developer 19. The magnet 12 is disposed within the developing sleeve 11 so that the developing pole $S_2$ is opposite the photosensitive drum 1. The developing pole $S_2$ forms a magnetic field in the vicinity of the developing region between the developing sleeve 11 and the photosensitive drum 1, and a magnetic brush is formed by the magnetic field.

A regulating blade 15 is disposed above the developing sleeve 11 so as to regulate the layer thickness of the developer 19 on the developing sleeve 11. The regulating blade 15 comprises a non-magnetic material, such as aluminum or SUS 316 and is disposed to have an end which is spaced from the developing sleeve 11 by 300–1000 μm, preferably 400–900 μm. If the spacing is below 300 μm, the magnetic carrier is liable to plug the spacing to cause an irregularity in the developer layer formed and further fail to form a developer coating layer required for good development, thus resulting in developed images which are thin in density and with much irregularity. In order to prevent irregular coating (or so-called blade plugging) caused by unnecessary particles possibly commingling within developer, it is preferred to have a spacing of at least 400 μm. If the spacing is larger than 1000 μm, the developer amount supplied onto the developing sleeve 11 is increased, thus failing to provide a specifically regulated developer layer thickness and resulting in much magnetic carrier attachment onto the photosensitive drum 1. The circulation and regulation by the non-magnetic blade 15 of the developer become insufficient, thus providing a toner having insufficient triboelectric charge and resulting in fog.

The angle $\theta_1$ may be set at −5 degrees to +35 degrees, preferably 0 to 25 degrees. If $\theta_1 < -5$ degrees, the developer thin layer formed by magnetic force, image force and agglomerating force acting on the developer is liable to be sparse and irregular. If $\theta > 35$ degrees, the developer coating amount is increased and if becomes difficult to obtain a prescribed developer coating amount.

Even if the sleeve 11 is rotated in the arrow direction, the movement of the magnetic carrier particle layer becomes gradually slower as it leaves away from the sleeve surface due to a balance between a constraint by gravity and the conveying force exerted by movement of the sleeve. Some can fall under the action of the gravity.

Accordingly, by appropriately selecting the position of the magnetic poles $N_1$ and $N_2$, and also the flowability and magnetic properties of the magnetic carrier particles, the magnetic carrier particles closer to the sleeve are preferentially conveyed toward the magnetic pole $N_1$ to form a moving layer. According to the movement of the magnetic carrier particles, the developer is conveyed accompanying the rotation of the developing sleeve to the developing region where the developer is used for development. An upstream toner scattering-preventing member 21 and a downstream toner scattering-preventing member 22 are further provided to prevent toner scattering.

Figure 7:
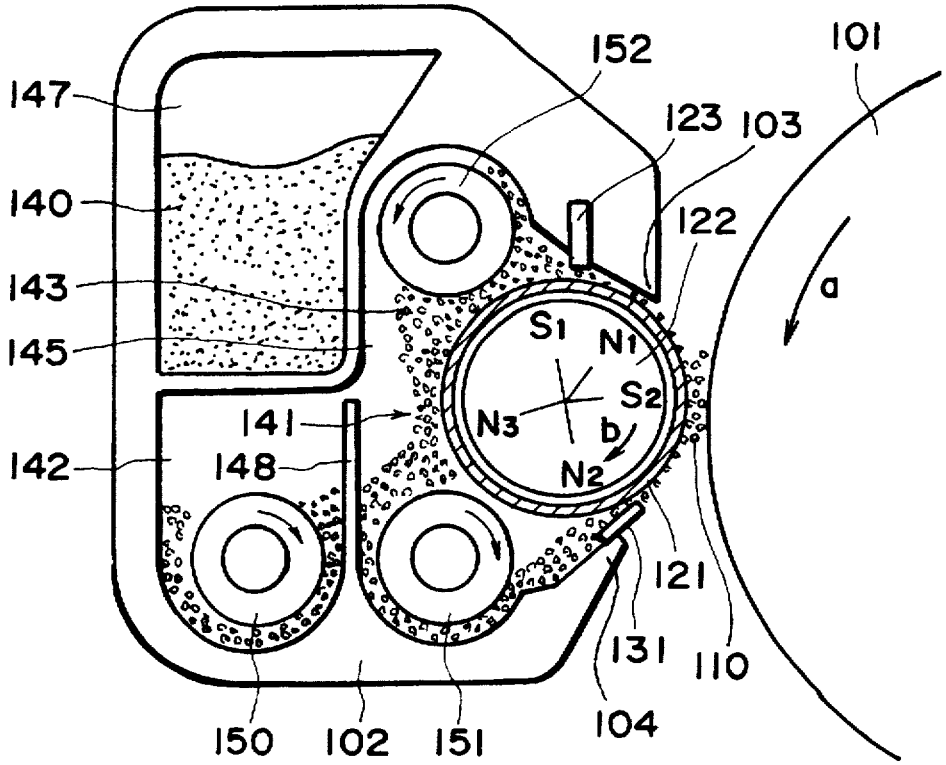
FIG. 7 is a schematic illustration of an image forming apparatus suitable for performing another embodiment of the image forming method according to the invention.

Another embodiment of an image forming apparatus, particularly a developing apparatus, usable in the image forming method according to the present invention is illustrated in FIG. 7.

Referring to FIG. 7, the developing apparatus includes a developer container 102 having a developer chamber 145 in which a non-magnetic developing sleeve (developer-carrying member) 121 having a specific surface shape is disposed opposite to an electrostatic latent image-bearing member 101 rotated in an arrow a direction. In the developing sleeve 121, a magnetic roller 102 as a magnetic field-generating means is disposed immovably and provided with magnetic poles $S_1$, $N_1$, $S_2$, $N_2$ and $N_3$ in this order in an arrow b direction from the pole $S_1$ disposed almost at the highest position.

The developing chamber 145 contains a two-component-type developer 141 comprising a mixture of a non-magnetic toner 140 and a magnetic carrier 143.

The developer 141 is introduced into a stirring chamber 142 equipped with a partitioning wall 148 having an upper opening end through one opening (not shown) of the wall 148 at one end of the developing chamber 145 in the developer container 102. Into the stirring chamber 142, the non-magnetic toner 140 is replenished from a toner chamber 147 and the developer 141 conveyed toward the other end of the stirring chamber 142 while being mixed with a first developer stirring and conveying means 150. The developer 141 conveyed to the other end of the stirring chamber 142 is returned to the developing chamber 145 through the other opening (not shown) of the partitioning wall 148 and stirred and conveyed by a second developer stirring and conveying means 151 in the developing chamber 145 and a third developer stirring and conveying means 152 disposed at an upper part in the developing chamber 145 and conveying the developer in direction opposite to the conveying direction of the conveying means 151, whereby the developer is supplied to the developing sleeve 121.

The developer 141 supplied to the developing sleeve 121 magnetically constrained under the action of a magnetic force exerted by the magnet roller 122 and carried on the developing sleeve 121. The developer 141 is formed into a thin layer under the regulation of a developer regulating blade 123 disposed confronting almost the highest position of the developing sleeve 21 and conveyed along with the rotation of the developing sleeve 21 in the arrow b direction to a developing zone 110 confronting the electrostatic latent image-bearing member 101, where the developer is used for developing an electrostatic latent image on the latent image-bearing member 101. The developer 141 not consumed for development is recovered into the developer container 102 along with the rotation of the developing sleeve 121. An upstream toner scattering-preventing member 103 and a downstream toner scattering-preventing member 104 are further provided to prevent toner scattering.

In the developer container 102, the residual developer magnetically constrained on the developing sleeve 121 is peeled off from the developing sleeve 121 by a repulsive magnetic field acting between poles $N_2$ and $N_3$ of the same polarity. In order to prevent scattering of the toner at the time when the developer 141 stands up to form ears along magnetic lines of force caused by the pole $N_2$, an elastic sealing member 131 is fixedly disposed at a lower part of the developer container 102 so that its one end contacts the developer 141.

We have further studied about the image density, highlight reproducibility and thin-line reproducibility in a color image forming method. As a result, it has been found that excellent performances can be accomplished regarding the above items when a toner having a specific particle size distribution as described hereinbelow is used in an image forming method including a developing step by application of the above-mentioned specific alternating electric field.

The toner may preferably comprise toner particles and an external additive, and the toner particles have a weight-average particle size of 3–7 μm, include more than 40% by number of particles of at most 5.04 μm, 10–70% by number of particles of at most 4 μm, 2–20% by volume of particles of at least 8 μm, and 0–6% by volume of particles of at least 10.08 μm.

The toner having the above-mentioned particle size distribution can faithfully develop a latent image formed on a photosensitive member, can show an excellent reproducibility of minute dot images inclusive of digital images, and can provide images excellent in gradation characteristic of highlight portion and resolution. Further, high-quality images are retained even when continuous image formation of copying or printing out is performed, and high-density images can be reproduced at a smaller toner consumption than conventional non-magnetic toners. Thus, the toner is advantageous from the view points of economy and size reduction of copiers or printers.

However, even if a toner having a potentially excellent image reproducibility can fail to exhibit its excellent performance under application of conventional continuous sine wave or alternating rectangular waveform, because a sufficient electric field is not applied for a latent image having a small developing (voltage) contrast, such as highlight images, to which an increased proportion of toner does not reach the image-bearing member under application of such a continuous alternating electric field. In other words, under such bias application conditions, a substantial portion of toner causes a mere vibrational movement and does not reach the image-bearing member.

However, good highlight images free from roughness can be obtained if the above-mentioned intermittent alternating developing electric field is applied. In this case, the toner similarly causes a vibrational movement and does not reach the image-bearing member by application of one cycle of the alternating electric field. However, during the application of the third voltage (i.e., the period of non-application of the alternating electric field), in case where a potential difference Vcont between the surface potential and the DC component of the developing bias satisfies Vcont<0, Vcont functions to direct the toner toward the developer-carrying member to localize the toner on the developer-carrying member side and, in case of Vcont>0 reversely, Vcont functions to direct the toner toward the image-bearing member depending on the image-bearing member depending on the latent image potential difference on the image-bearing member, so that the toner is localized on the image-bearing member side in an amount corresponding to the latent image potential. On further application of the alternating electric field, the toner having reached the image-bearing member side oscillates thereat to be concentrated at the latent image portion. As a result, the dot shape is uniformly reproduced to provide images free from irregularity.

For the reason described above, if a latent image is developed under application of the intermittent alternating bias electric field, the lacking of dot images can be obviated even in a highlight latent image. Further as the toner repetitively oscillates on the image-bearing member, the toner is concentrated at the latent image part to faithfully reproduce individual dots. Further, while using a two component-type developer, the contact of the magnetic brush onto the image-bearing member is suppressed to provide uniform halftone images.

Various parameters characterizing the present invention are based on values measured in the following manners.

(1) Magnetic properties of carrier

The apparatus used is a commercially available magnetization tester ("Model BHU-60", available from Riken Sokutei K. K.). Ca. 1.0 g of a sample is weighed and packed in a cell measuring 7 mm in diameter and 10 mm in height, and the cell is set in the apparatus. The sample in the cell is then supplied with a magnetic field which is gradually increased up to a maximum value of 3,000 oersted. Then, the magnetic field is gradually decreased. A B-H hysteresis cure during the process is drawn on a recording paper. The saturation magnetization, residual magnetization and coercive fore of the sample are obtained from the hysteresis curve.

(2) Particle size distribution of carrier

The apparatus used is a micro-track particle size analyzer ("SRA-type", available from Nikkiso K. K.), and the measurement range is set to 0.7–125 μm. From the resultant volume-basis particle size distribution, a 50% particle size ($D_{50}$) is obtained.

(3) Current value of carrier 800 g of a carrier sample is weighed and exposed for at least 15 min. to an environment (room temperature: 22°–25° C., humidity: 50–54%). A counter electrode is disposed opposite to and 1 mm spaced apart from an electroconductive sleeve containing a magnet roller and provided with an ear-regulating blade. The carrier is magnetically attracted between the sleeve and counter electrode. The magnet roller in the sleeve is rotated so that a magnetic brush of the carrier with ears standing on the sleeve contacts the counter electrode. Then, a DC voltage of 500 volts is applied between the sleeve and the counter electrode to measure a voltage decrease between both ends of resistors of 1M.ohm and 10 k.ohm connected in series. A current value is calculated from the value.

(4) Toner particle size (weight-average particle size)

The average particle size and particle size distribution of a toner may be measured by a Coulter counter (e.g., "Model TA-II" or "Coulter Multisizer", available from Coulter Electronics Inc.). Herein, we have used Coulter Multisizer, to which an interface (available from Nikkaki K. K.) for providing a number-basis distribution and a volume-basis distribution, and a personal computer PC 9801 (available from NEC K. K.) are connected.

For measurement, a 1%-NaCl aqueous solution as an electrolyte solution is prepared by using a reagent-grade sodium chloride. Into 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution by using the above-mentioned Coulter Multisizer with a 100 micron-aperture to obtain a number-basis distribution and a volume basis distribution for particles having a particle size of 2 μm or larger. From these distributions, it is possible to obtain a volume-average particle size (Dv, by using a central value for each channel as a representative value for the channel) and a weight-average particle size ($D_4$) based on the volume-basis distribution, a length-average particle size ($D_1$) based on the number-basis distribution, volume-basis contents of particle size fractions (≧8.00 μm and ≦3.17 μm) and number-basis contacts of particle size fractions (≦5 μm and ≦3.17 μm).

(5) Weight-average particle size of external additive (inorganic fine powder)

The measurement is performed by using a micro-track particle size analyzer ("Model 8230 UPA", available from Nikkiso K. K.) in the following manner.

20 ml of ethanol is placed in a 50 cc-glass beaker. A sample is added so as to provide a Reflected Power indication of 200 mV, and dispersion is performed for 3 min. by an ultrasonic wave generator ("UD 200", available from Tomy Seiko K. K.). The sample dispersion liquid is taken in 6 ml and subjected to three times of measurement at 22° C. to obtain a volume-basis particle size distribution, from which a weight-average particle size is calculated.

(6) Hydrophobicity of inorganic fine powder

A methanol titration test is performed.

0.2 g of a sample inorganic fine powder is added to 50 ml of water in a 250 cc-Erlenmeyer flask. While the content in the flask is continuously stirred with a magnetic stirrer, methanol is gradually added to the flask until all the inorganic fine power is wetted. The terminal point is detected by observing all the inorganic fine powder is suspended in the liquid. The hydrophobicity is determined as a methanol content (%) in the methanol-water mixture at the terminal point.

(7) Light transmittance

| | |
|---|---|
| Sample | 0.10 g |
| Alkyd resin ("Beckozole 1323-6-EL", mfd. by Dainippon Ink K. K.) | 13.20 g |
| Melamine resin ("Super Beckamine J-820-60", mfd. by Dai Nippon Ink K. K.) | 3.30 g |
| Thinner ("Aramic Thinner", mfd. by Kansai Paint K. K.) | 3.50 g |
| Glass medium | 50.00 g |

The above formulation is placed in a 150 cc-glass bottle and subjected to dispersion for 1 hour by a paint conditioner (mfd. by Red Devil Co.). After the dispersion, the composition is applied on a PET film by a doctor blade 2 mm spaced from the PET film, followed by baking at 120° C. for 10 min. The thus-coated sheet is subject to measurement of transmittance in a range of 320–800 nm by a transmittance meter ("U-BEST 50", mfd. by Nippon Bunko K. K.).

(8) Specific surface area $S_1$ (air permeation method)

Measurement is performed by using a specific surface area meter ("Model SS-100", mfd. by Shimazu Seisakusho K. K.) in the following manner.

1) A variable-voltage power supply to a powder tester for sample powder packing is turned on and adjusted to 100 V.

2) A changeover switch for the powder tester is set to a tap position and the timer is set for 1 min. (50 times±1 time/1 min.).

3) A sieve plate is inserted into a plastic-made sample tube and a sheet of filter paper is placed thereon, and a sample is placed thereon up to a ⅓ position of the sample tube.

4) The sample tube is set on a tap stand of the powder tester, and a tapping start button is pressed (tapping for 1 min.).

5) Into the tapped sample tube, an additional amount of the sample is placed up to a ⅔ position of the sample tube.

6) Tapping is performed similarly as 4) above.

7) A supplemental tube is inserted to the top of the sample tube, and an additional amount of the sample is added so as to form a pile of the sample.

8) Tapping is performed similarly as the above 4) or 6).

9) The tapped sample tube is taken out of the tap stand, the supplemental tube is pulled out, and an excessive amount of the sample is cut by a spatula.

10) Water is poured into a metering pipe for a specific surface area up to an S mark.

11) The sample tube is connected with the metering pipe (after the sample packing, grease is applied onto the ground joint face).

12) A cock for the lower effluent port is opened, and a stopwatch is started when the water level passes a 0 (zero) mark of the metering pipe (the effluent water is received by a beaker).

13) A time required for the water level to descent down to a 20 cc-mark is measured.

14) The sample tube is taken out and the sample is weighed.

15) The specific surface area SW ($=S_1$) of the sample is calculated from the following equation:

$$SW = \frac{14}{\rho}\sqrt{\frac{\Delta PAT}{\eta LQ}\cdot\frac{\epsilon^3}{(1-\epsilon)^2}}$$

$$\epsilon = 1 - \frac{W}{\rho AL}$$

SW: specific surface area of a powder sample [$cm^2/g$]
e: void ratio of a packed sample layer
ρ: density of the powder sample [$g/cm^3$]
η: viscosity coefficient of fluid (air) [g/cm.sec]
L: thickness of the sample layer [cm]
Q: amount of fluid having passed the sample layer [cc]
ΔP: pressure different between both ends of the sample layer [cc]
A: sectional area of the sample layer [$cm^2$]
t: time in which the Q (20) cc of fluid (air) has passed through the sample layer [sec]
W: sample weight [g]

(9) Carrier density ρ

An apparatus used in "Aqupic 1330" (available from Shimazu Seisakusho K. K.). A sample carrier is packed into a 10 $cm^3$-measurement cell up to ca. 80% thereof while lightly tapping the cell. The sample cell is dried in a vacuum drier at 40° C., weighed and inserted into an apparatus main body. Then, the sample is subjected to 10 cycles of packing under a pressure of 134, 45 kPa and purging and then 5 times of measurement at a packing pressure of 134.45 kPa and an equilibrium pressure of 0.0345 kPa. An average value is taken as a carrier density.

(10) Acid value

2–10 g of a sample resin is weighed into a 200 to 300 ml-Erlenmeyer flask, and ca. 50 ml of a methanol/toluene (=30/70) mixture solvent is added thereto to dissolve the resin. If the solubility is low, a small amount of acetone can be added. The sample solution is titrated with a preliminarily standardized N/10-potassium hydroxide/alcohol solution with a mixture indicator of 0.1% Bromo Thymol Blue and Phenol Red. The acid value is calculated from the consumed amount of the KOH solution as follows.

Acid value=KOH (ml)×N×56.1/sample weight, wherein N denotes the factor of the N/10-KOH solution used.

(11) Glass transition temperature Tg

A differential scanning calorimeter ("DSC-7", mfd. by Perkin-Elmer Corp.) is used.

A sample is accurately weighed in an amount of 5–20 g, preferably ca. 10 g. The weighed sample is placed in an aluminum pan and subjected to temperature raising at a rate of 10° C./min in a temperature range of 30°–200° C. in a normal temperature—normal humidity environment to obtain a differential thermal curve. In the temperature raising stage, a main absorption peak appears in the range of 40°–100° C. A median line is drawn between base lines before and after the appearance of the main absorption peak. The glass transition temperature Tg of the sample is determined as the temperature at an intersection of the median line and the differential thermal curve.

As described above, according to the two component-type developer of the present invention containing the carrier formed by coating magnetic carrier core particles comprising a specific ferrite component with a resin coating layer, it is possible to obviate difficulties, such as a decrease in image density and fog even in continuous reproduction of a color original having a large image area. Further, a quick increase in triboelectric charge in the initial stage is accomplished, and fog-free, clear images can be retained even after a continuous image formation on a large number of sheets. Further, the triboelectric chargeability is little affected by a change in environmental conditions. Further, a good conveyability in the developing device is accomplished.

Hereinbelow, the present invention will be described more specifically based on Examples wherein "part(s)" means "part(s) by weight".

[Production Examples 1–3 of Magnetic Carrier Core Particles]

20 parts of MgO (solubility: 0.62 mg/100 ml), 20 parts of MnO and 60 parts of $Fe_2O_3$ were respectively formed into fine particles and mixed with each other together with water to be formed into particles. Then, the particles were calcined at 1100 ° C. and subjected to particle size adjustment to provide ferrite carrier core particles (σs (saturation magnetization)=58 $Am^2/kg$) A, B and C having average particle sizes (Dav.) of 35.7 μm, 25.6 μm and 61.3 μm, respectively.

[Production Example 4 of Magnetic Carrier Core Particles]

Ferrite carrier core particle D (σ=60 $Am^2/kg$) having an average particle size of 36.3 μm was prepared in the same manner as in Production Example 1 except for the use of 15 parts of MgO, 10 parts of NiO, 3 parts of $Al_2O_3$, and 72 parts of $Fe_2O_3$.

[Production Example 5 of Magnetic Carrier Core Particles]

Ferrite carrier core particles E (σs=65 $Am^2/kg$) having an average particle size of 39.3 μm was prepared in the same manner as in Production Example 1 except for the use of 3 parts of $Ag_2O$ (solubility: 1.74 mg/100 ml) 27 parts of MnO and 70 parts of $Fe_2O_3$.

[Production Example 6 of Magnetic Carrier Core Particles]

Ferrite carrier core particle F (σs=57 $Am^2/kg$) having an average particle size of 36.0 μm was prepared in the same manner as in Production Example 1 except for the use of 20 parts of BaO (solubility: ≦1 g/100 ml), 20 parts of ZnO, and 60 parts of $Fe_2O_3$.

[Production Example 7 of Magnetic Carrier Core Particles]

Ferrite carrier core particles G ($\sigma s$=55 $Am^2/kg$) having an average particle size of 36.8 μm was prepared in the same manner as in Production Example 1 except for the use of 5 parts of $K_2O$ (solubility: ≦1 g/100 ml), 20 parts of NiO and 73 parts of $Fe_2O_3$.

[Production Example 8 of Magnetic Carrier Core Particles]

Ferrite carrier core particle H ($\sigma s$=47 $Am^2/kg$) having an average particle size of 37.5 μm was prepared in the same manner as in Production Example 1 except for the use of 35 parts of MgO (solubility: 0.62 mg/100 ml), 5 parts of MnO, and 60 parts of $Fe_2O_3$.

[Production Example 9 of Magnetic Carrier Core Particles]

Ferrite carrier core particles I ($\sigma s$=63 $Am^2/kg$) having an average particle size of 35.5 μm was prepared in the same manner as in Production Example 1 except for the use of 0.002 parts of MgO (solubility: 0.62 mg/100 ml) 25 parts of MnO and 74.998 parts of $Fe_2O_3$.

[Production Example 10 of Magnetic Carrier Core Particles]

Ferrite carrier core particle J ($\sigma s$=15 $Am^2/kg$) having an average particle size of 35.8 μm was prepared in the same manner as in Production Example 1 except for the use of 10 parts of MgO (solubility=0.62 mg/100 ml), 80 parts of MnO, and 10 parts of $Fe_2O_3$.

[Production Example 11 of Magnetic Carrier Core Particles]

Production of ferrite carrier core particles was tried in the same manner as in Production Example 1 except for the use of 25 parts of MgO (solubility: 0.62 mg/100 ml) and 75 parts of $Fe_2O_3$. However, adequate carrier particles could not be produced due to severe coalescence of the particles.

[Production Example 12 of Magnetic Carrier Core Particles]

Ferrite carrier core particle K ($\sigma s$=20 $Am^2/kg$) having an average particle size of 36.3 μm was prepared in the same manner as in Production Example 1 except for the use of 20 parts of MgO (solubility: 0.62 mg/100 ml), 65 parts of MnO, and 15 parts of $Fe_2O_3$.

[Production Example 13 of Magnetic Carrier Core Particles]

Ferrite carrier core particles L ($\sigma s$=70 $Am^2/kg$) having an average particle size of 38.5 μm was prepared in the same manner as in Production Example 1 except for the use of 3 parts of MgO (solubility: 0.62 mg/100 ml), 1 part of MnO and 96 parts of $Fe_2O_3$.

(Carrier Production Examples 1–7)

20 parts of toluene, 20 parts of butanol, 20 parts of water and 40 parts of ice were added into a four-necked flask and under stirring, 40 parts of a mixture of $CH_3SiCl_3/(CH_3)_2SiCl_2$ (=15/10 by mol) was added thereto, followed further by 30 min. of stirring and 1 hour of condensation reaction at 60° C. Then, the resultant siloxane was washed sufficiently with water and dissolved in a toluene-methyl ethyl ketone-butanol mixture solvent to prepare a silicone varnish with a solid matter content of 10%.

To 100 parts of the silicone varnish were added 2.0 parts of deionized water, 2.0 parts of the following curing agent

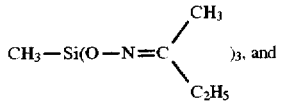

3.0 parts, of the following aminosilane coupling agent

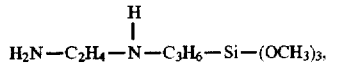

respectively based on the siloxane solid matter content, to prepare Carrier Coating liquid I.

The above-prepared Ferrite carrier core particles A–G were respectively coated with Coating liquid I thus-prepared so as to provide a resin coating rate of 1.0 wt. %, by using a coater ("Spira Coater", mfd. by Okada Seiko K. K.), thereby to obtain Coated Carriers 1–7.

(Carrier Production Example 8)

Coated Carrier 8 was prepared in the same manner as in Carrier Production Example 1 except for replacing the aminosilane coupling agent with the following aminosilane coupling agent to prepare Coating liquid II and using Coating liquid II instead of Coating liquid I:

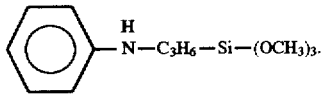

(Carrier Production Example 9)

Coated Carrier 9 was prepared in the same manner as in Carrier Production Example 1 except for omitting the siloxane and the curing agent (i.e. using only the aminosilane coupling agent to prepare Coating liquid III and using Coating liquid III instead of Coating liquid I.

(Carrier Production Example 10)

Coated Carrier 10 was prepared in the same manner as in Carrier Production Example 1 except for omitting the aminosilane coupling agent to prepare Coating liquid IV and using Coating liquid IV instead of Coating liquid I.

(Carrier Production Examples 11–15)

Coated Carriers 11–15 were was prepared in the same manner as in Carrier Production Examples 1–7 except for replacing Ferrite carrier core particles A–G with Ferrite carrier core particles H–L.

Table 1 below shows characterization data of Coated Carriers 1–15 thus prepared.

TABLE 1

| Carrier | Core | $D_{50}$ (μm) | +88 μm (%) | +62 μm (%) | −22 μm (%) | −16 μm (%) | $S_1$ ($cm^2/g$) | $S_2$ ($cm^2/g$) | S1/S2 | $\rho_{ap}$ ($g/cm^2$) | Core elements | Coating | Current value (μA) |
|---|---|---|---|---|---|---|---|---|---|---|---|---|---|
| 1 | A | 35.8 | 0.8 | 8.0 | 7.4 | 0 | 540 | 364 | 1.48 | 2.2 | Mg—Mn—Fe | I | 120 |
| 2 | B | 26.0 | 0 | 1.0 | 14.2 | 0 | 780 | 502 | 1.55 | 2.0 | Mg—Mn—Fe | I | 140 |
| 3 | C | 61.3 | 7.6 | 30.3 | 1.6 | 0 | 270 | 213 | 1.27 | 2.5 | Mg—Mn—Fe | I | 90 |
| 4 | D | 36.5 | 0.8 | 8.4 | 7.5 | 0 | 590 | 355 | 1.66 | 2.3 | Mg—Ni—Al—Fe | I | 110 |
| 5 | E | 39.5 | 1.2 | 8.8 | 5.4 | 0 | 455 | 330 | 1.38 | 2.4 | Ag—Mn—Fe | I | 100 |
| 6 | F | 36.2 | 0.8 | 8.2 | 8.0 | 0.3 | 510 | 360 | 1.42 | 2.4 | Ba—Zn—Fe | I | 120 |
| 7 | G | 37.0 | 0.9 | 10.2 | 7.5 | 0.1 | 495 | 353 | 1.40 | 2.3 | K—Ni—Fe | I | 150 |
| 8 | A | 35.9 | 0.8 | 8.0 | 7.4 | 0 | 545 | 364 | 1.50 | 2.2 | Mg—Mn—Fe | II | 70 |
| 9 | A | 35.6 | 0.7 | 8.0 | 7.5 | 0 | 540 | 364 | 1.48 | 2.2 | Mg—Mn—Fe | III | 80 |
| 10 | A | 36.1 | 0.9 | 8.1 | 7.3 | 0 | 535 | 363 | 1.47 | 2.2 | Mg—Mn—Fe | IV | 100 |

TABLE 1-continued

| Carrier | Core | $D_{50}$ (μm) | +88 μm (%) | +62 μm (%) | −22 μm (%) | −16 μm (%) | $S_1$ ($cm^2/g$) | $S_2$ ($cm^2/g$) | S1/S2 | $\rho_{ap}$ ($g/cm^2$) | Core elements | Coating | Current value (μA) |
|---|---|---|---|---|---|---|---|---|---|---|---|---|---|
| 11 | H | 37.5 | 1.0 | 8.5 | 7.0 | 0.3 | 490 | 345 | 1.42 | 2.2 | Mg—Mn—Fe | I | 110 |
| 12 | I | 35.5 | 0.8 | 7.9 | 7.3 | 0 | 545 | 364 | 1.50 | 2.3 | Mg—Mn—Fe | I | 130 |
| 13 | J | 35.8 | 0.8 | 8.2 | 7.1 | 0.3 | 543 | 364 | 1.49 | 2.4 | Mg—Mn—Fe | I | 150 |
| 14 | K | 36.3 | 0.9 | 8.5 | 6.8 | 0.5 | 515 | 354 | 1.45 | 2.3 | Mg—Mn—Fe | I | 150 |
| 15 | L | 38.5 | 1.3 | 9.2 | 6.5 | 0 | 495 | 339 | 1.46 | 2.2 | Mg—Mn—Fe | I | 220 |

$\rho_{ap}$: apparent density
$D_{50}$: represents a 50%-particle size of a coated carrier (Toner Production Example 1)

| | |
|---|---|
| Polyester resin (condensation product of propoxidized bisphenol with fumaric acid and trimellitic acid) | 100 parts |
| Phthalocyanine pigment | 4 parts |
| Di-tert-butylsalicylic acid metal complex | 4 parts |

The above ingredients were sufficiently preliminarily blended with each other by a Henschel mixer and melt-kneaded through a twin-screw extruder kneader. After cooling, the kneaded product was coarsely crushed into ca. 1–2 μm and finely pulverized by an air jet pulverizer, followed by classification to obtain blue powder (toner particles) having a weight-average particle size ($D_4$) of 5.8 μm.

100 parts of the above powder was blended by a Henschel mixer with 1.5 parts of hydrophobic anatase-type titanium oxide fine powder ($D_4$=0.05 μm, hydrophobicity ($H_{MeOH}$)=55%, transmittance (Tp)=70%) hydrophobized through treatment of 100 parts of anatase-type titanium oxide fine powder with 20 parts of n—$C_4H_9$—Si—$(OCH_3)_3$ in aqueous medium, thereby to obtain Cyan Toner a.

(Toner Production Example 2)

Cyan Toner b was prepared in the same manner as in Toner Production Example 1 except for using hydrophobic titanium oxide fine powder ($D_4$=0.0008 μm, HMeOH=50% and Tp=70%) prepared by hydrophobizing anatase-type titanium oxide fine powder in the form of a hydrate before calcination.

(Toner Production Example 3)

Cyan Toner c was prepared in the same manner as in Toner Production Example 1 except for using 2.0 parts of hydrophobic titanium oxide fine powder ($D_4$=0.04 μm, $H_{MeOH}$=70% and Tp=20%) prepared by using rutile-type titanium oxide fine powder (for pigment use) instead of the anatase-type titanium oxide fine powder.

(Toner Production Example 4)

Cyan Toner d was prepared in the same manner as in Toner Production Example 1 except for using hydrophobic titanium oxide fine powder ($D_4$=0.05 μm, $H_{MeOH}$=65% and Tp=65%) prepared by further treating the hydrophobized anatase-type titanium oxide fine powder with dimethylsilicone oil (100 cp).

(Toner Production Example 5)

Cyan Toner e was prepared in the same manner as in Toner Production Example 1 except for using hydrophobic silica fine powder ($D_4$=0.02 μm, $H_{MeOH}$=90% and Tp=34%) prepared by through treatment with dimethylsilicone oil (100 cp) in gaseous phase, instead of the anatase-type titanium oxide.

Example 1

A two component-type developer (toner concentration ($C_{toner}$)=7 wt. %) was prepared by blending the above-prepared Cyan Toner a and Carrier 1, and subjected to continuous image formation by using a color copying machine ("CLC 700", mfd. by Canon K. K.) using an intermittent alternating-electric field shown in FIG. 2 under a developing contrast of 300 volts for reproducing an original having an image area ratio of 25%. The continuous image formation was performed on 10000 sheets for each of normal temperature/normal humidity (23° C./65%) conditions, high temperature/high humidity (30° C./80% RH) conditions and normal temperature/low humidity (20° C./10% RH) conditions. The results are shown in Table 2 appearing hereinafter. As shown in Table 2, the two component-type developer showed little change in performance during the continuous image formation and good performances inclusive of substantially no scattering even after 10000 sheets of image formation.

Example 2

A two component-type developer ($C_{toner}$=9%) was prepared in a similar manner as in Example 1 except for using Carrier 2 instead of Carrier 1 and the above-mentioned toner concentration. The developer was evaluated in the same manner as in Example 1. The results are also shown in Table 2.

Example 3

A two component-type developer ($C_{toner}$=5%) was prepared in a similar manner as in Example 1 except for using Carrier 3 instead of Carrier 1 and the above-mentioned toner concentration. The developer was evaluated in the same manner as in Example 1. The results are also shown in Table 2.

Examples 4–7

Two component-type developers were prepared in a similar manner as in Example 1 except for using Carriers 4, 5, 8 and 10 instead of Carrier 1 in manners as shown in Table 2. The developers were evaluated in the same manner as in Example 1. The results are also shown in Table 2.

Comparative Examples 1–3

Two component-type developers were prepared in a similar manner as in Example 1 except for using Carriers 6, 7 and 9 instead of Carrier 1 in manners shown in Table 2. The developers were evaluated in the same manner as in Example 1. The results are also shown in Table 2.

Comparative Examples 4–9

Two component-type developers were prepared in a similar manner as in Example 1 except for using Carriers 11–15 instead of Carrier 1 in manners shown in Table 2. The developers were evaluated in the same manner as in Example 1. The results are also shown in Table 2.

TABLE 2

| Ex. or Comp. Ex. | Carrier | Toner | $C_{toner}$ (%) | Image density | Fog (%) | Durability (spent toner) | 30° C./80% toner scattering | 20° C./10% solid image uniformity |
|---|---|---|---|---|---|---|---|---|
| Ex. 1 | 1 | a | 7 | 1.6–1.7 | ~1.2 | ◎ | ◎ | ◎ |
| Ex. 2 | 2 | a | 9 | 1.7–1.8 | ~1.3 | ◎ | ◎ | ◎ |
| Ex. 3 | 3 | a | 5 | 1.5–1.6 | ~1.5 | ◎ | Δ | ○ |
| Ex. 4 | 4 | a | 7 | 1.6–1.7 | ~1.3 | ◎ | ◎ | ○ |
| Ex. 5 | 5 | a | 7 | 1.6–1.7 | ~1.3 | ◎ | ○ | ◎ |
| Comp. Ex. 1 | 6 | a | 7 | 1.7–1.8 | ~2.0 | Δ | Δ | ○ |
| Comp. Ex. 2 | 7 | a | 7 | 1.7–1.9 | ~2.0 | Δ | Δ | Δ |
| Ex. 6 | 8 | a | 7 | 1.6–1.7 | ~1.3 | ◎ | ◎ | ◎ |
| Comp. Ex. 3 | 9 | a | 7 | 1.6–1.9 | ~2.0 | Δ | Δ | ○ |
| Ex. 7 | 10 | a | 7 | 1.7–1.8 | ~1.3 | ◎ | ○ | ◎ |
| Comp. Ex. 4 | 11 | a | 7 | 1.8–2.0 | ~2.0 | Δ | x | ○ |
| Comp. Ex. 5 | 12 | a | 7 | 1.5–1.7 | ~2.0 | Δ | Δ | x |
| Comp. Ex. 6 | 13 | a | 7 | 1.5–1.8 | ~2.3 | x | Δ | x |
| Comp. Ex. 7 | 14 | a | 7 | 1.5–1.7 | ~2.5 | x | x | x |
| Comp. Ex. 8 | 15 | a | 7 | 1.2–1.4 | ~2.0 | Δ | Δ | x |

The manner of performance evaluation and the evaluation standards are supplemented at the end of this specification.

(Carrier Production Examples 17 and 18)

Coated Carriers 17 and 18 were prepared in the same manner as in Carrier Production Example 1 except for changing the amount of water added at the time of producing Coating liquid to 0 part and 7 parts, respectively.

Example 8

A two component-type developer was prepared and evaluated in the same manner as in Example 1 except for the use of Carrier 17. As a result, a slight fog of 1.5% was caused in continuous image formation under 20° C./10% RH, while that was a practically acceptable level. The inferior performance might be attributable to insufficient resin coating due to non-use of the water.

Example 9

A two component-type developer was prepared and evaluated in the same manner as in Example 1 except for the use of Carrier 18. As a result, a slight toner scattering was observed when the toner concentration was close to the upper limit of the control range under 30° C./80% RH, while that was a practically acceptable level. The result might be attributable to the use of too much water causing a excessive self-crosslinking of the resin to result in a somewhat lower adhesion with the carrier core particles.

Example 10

A two component-type developer was prepared and evaluated in the same manner as in Example 1 except for using Toner b instead of Toner a. As a result, the image qualities at the initial stage were good but the uniformity of a solid image was slightly lowered and the fog was somewhat increased to 1.6% under 20° C./10% RH.

Example 11

A two component-type developer was prepared and evaluated in the same manner as in Example 1 except for using Toner c instead of Toner a. As a result, toner scattering slightly occurred and fog was increased to 1.7% under 30° C./80% RH.

Example 12

A two component-type developer was prepared and evaluated in the same manner as in Example 1 except for using Toner d instead of Toner a. As a result, fog was at a good level of 0.9%. The uniformity of a solid image was slightly lowered under 20° C./10% RH, but the performances were generally good.

Example 13

A two component-type developer was prepared and evaluated in the same manner as in Example 1 except for using Toner e instead of Toner a. As a result, the uniformity of a solid image was slightly lowered under 20° C./10% RH, and the fog was somewhat increased to 1.5% under 30° C./80% RH. The performances were, however, generally good.

Example 14

Figure 4:
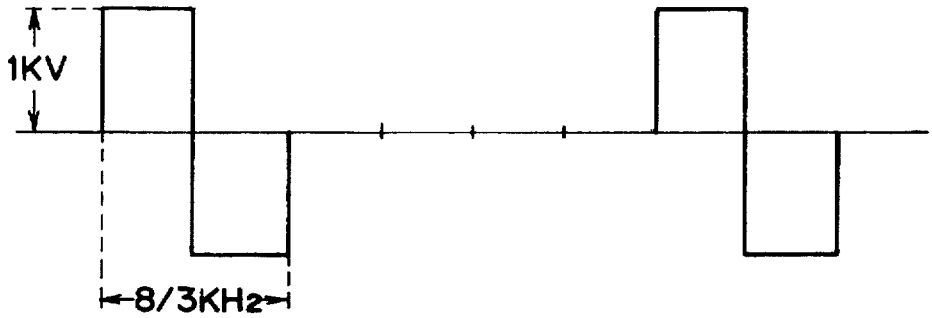

The two component-type developer comprising Toner a and Carrier 1 used in Example 1 was subjected to continuous image formation by using an image forming apparatus shown in FIG. 1 and equipped with a developing sleeve containing a 5-pole magnet roller including a developing principal magnetic pole of 960 gauss under application of an intermittent alternating electric field shown in FIG. 4 providing developing conditions of Vcont=230 volts, Vback=−930 volts under environmental conditions of 23° C./60% RH.

As a result, even after image formation on 10000 sheets, the fog was at a good level of 1.0%, and the uniformity of solid image was good under 20° C./10% RH. Thus, very good performances were attained.

Example 15

Figure 3:
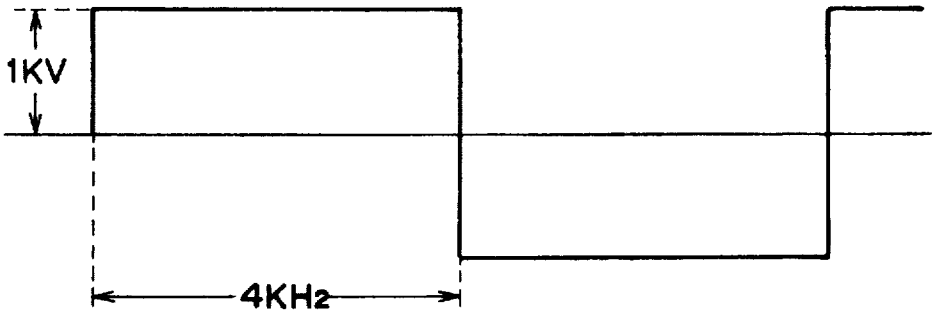

An image forming test was performed in the same manner as in Example 14 except for using an alternating electric field shown in FIG. 3.

As a result, the solid uniformity was somewhat lowered and the fog was somewhat increased to 1.4% under 20° C./10% RH. The performances were, however, generally good.

Example 16

Figure 5:
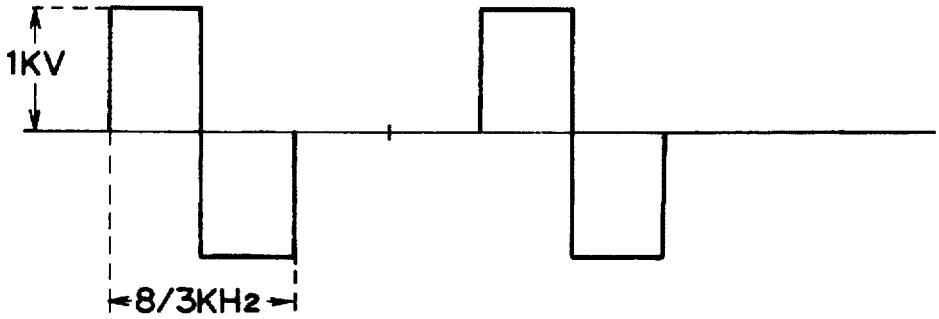

An image forming test was performed in the same manner as in Example 14 except for using an alternating electric field shown in FIG. 5.

As a result, the solid uniformity was somewhat lowered under 20° C./10% RH. The performances were, however, generally good.

[Production Example 16 of Magnetic Carrier Core Particles]

20 parts of MgO (solubility: 0.62 mg/100 ml), 20 parts of MnO and 60 parts of $Fe_2O_3$ were respectively formed into fine particles and mixed with each other together with water to be formed into particles. Then the particles were calcined at 1100° C. and subjected to particle size adjustment to provide Ferrite carrier core particles M ($\sigma s$ (saturation magnetization)=58 $Am^2/kg$) having average particle sizes (Dav.) of 35.7 μm.

[Production Example 17 of Magnetic Carrier Core Particles]

Ferrite carrier core particle N ($\sigma s$=60 $Am^2/kg$) having an average particle size of 38.3 μm was prepared in the same manner as in Production Example 16 except for the use of 15 parts of MgO, 15 parts of MnO, 3 parts of $SiO_2$ and 67 parts of $Fe_2O_3$, and calcination at 1300° C.

[Production Example 18 of Magnetic Carrier Core Particles]

Ferrite carrier core particles O ($\sigma s$=57 $Am^2/kg$) having an average particle size of 40.5 μm was prepared in the same manner as in Production Example 16 except for the use of 3 parts of MgO, 5 parts of $Li_2O$ and 92 parts of $Fe_2O_3$.

[Production Example 19 of Magnetic Carrier Core Particles]

Ferrite carrier core particle P ($\sigma s$=57 $Am^2/kg$) having an average particle size of 43.2 μm was prepared in the same manner as in Production Example 16 except for the use of 20 parts of MgO, 5 parts of $Al_2O_3$, and 75 parts of $Fe_2O_3$.

(Carrier Production Examples 16–19)

Coated Carriers 16–19 were prepared in the same manner as in Carrier Production Examples 1–7 except for replacing Ferrite carrier core particles A–G with Ferrite carrier core particles M–P and changing the resin coating rate with Coating liquid I to 0.5 wt. %.

(Carrier Production Example 20)

Coated Carrier 20 was prepared in the same manner as in Carrier Production Example 16 except for using Coating liquid V prepared by mixing 50 parts of styrene 2-ethylhexyl acrylate/methyl methacrylate (=50/20/30) copolymer and 50 parts vinylidene fluoride/tetrafluoroethylene (=50/50) copolymer, and dissolving the mixture in a toluene/methyl ethyl ketone mixture solvent.

Table 3 below shows characterizing data of Coated Carriers 16–20 thus prepared.

TABLE 3

| Carrier | Core | $D_{50}$ (μm) | +88 μm (%) | +62 μm (%) | −22 μm (%) | −16 μm (%) | $S_1$ ($cm^2/g$) | $S_2$ ($cm^2/g$) | S1/S2 | $\rho_{ap}$ ($g/cm^2$) | Core elements | Coating | Current value (μA) |
|---|---|---|---|---|---|---|---|---|---|---|---|---|---|
| 16 | M | 35.8 | 0.8 | 8.0 | 7.4 | 0 | 540 | 364 | 1.48 | 2.2 | Mg—Mn—Fe | I | 120 |
| 17 | N | 38.3 | 1.0 | 8.3 | 6.5 | 0 | 510 | 340 | 1.50 | 2.3 | Mg—Mn—Si—Fe | I | 60 |
| 18 | O | 40.5 | 1.3 | 9.0 | 5.8 | 0 | 480 | 322 | 1.49 | 2.3 | Mg—Li—Fe | I | 42 |
| 19 | P | 43.2 | 1.4 | 10.0 | 4.2 | 0 | 450 | 302 | 1.49 | 2.2 | Mg—Al—Fe | I | 70 |
| 20 | M | 36.0 | 0.9 | 8.2 | 7.0 | 0 | 530 | 362 | 1.46 | 2.2 | Mg—Mn—Fe | V | 110 |

$\rho_{ap}$: apparent density
$D_{50}$: represents a 50%-particle size of a coated carrier

[Polyester resin Synthesis Example 1]

| | |
|---|---|
| Polyoxypropylene(2,2)-2,2-bis(4-hydroxyphenyl)propane | 45 mol. % |
| Polyoxyethylene(2)-2,2-bis(4-hydroxyphenyl)propane | 6 mol. % |
| Fumaric acid | 47 mol. % |
| Trimellitic anhydride | 2 mol. % |

The above ingredients were subjected to polycondensation with dibutyltin oxide as the catalyst under nitrogen stream at 200° C. The reaction was terminated at a point of providing a softening point (according to ASTM E28-51T) of 92° C. to provide Polyester resin (I), which showed an acid value (AV) of 9.5 mgKOH/g and a glass transition temperature (Tg) of 57.2° C.

[Polyester resin Synthesis Example 2]

| | |
|---|---|
| Polyoxypropylene(2,2)-2,2-bis(4-hydroxyphenyl)propane | 45 mol. % |
| Polyoxyethylene(2)-2,2-bis(4-hydroxyphenyl)propane | 4 mol. % |
| Fumaric acid | 40 mol. % |
| Terephthalic acid | 10 mol. % |
| Trimellitic anhydride | 1 mol. % |

The above ingredients were subjected to polycondensation with dibutyltin oxide as the catalyst under nitrogen stream at 200° C. The reaction was terminated at a point of providing a softening point of 91° C. to provide Polyester resin (II), which showed an acid value (AV) of 22.0 mgKOH/g and a glass transition temperature (Tg) of 55.3° C.

[Polyester resin Synthesis Example 3]

| | |
|---|---|
| Polyoxypropylene(2,2)-2,2-bis(4-hydroxyphenyl)propane | 45 mol. % |
| Polyoxyethylene(2)-2,2-bis(4-hydroxyphenyl)propane | 10 mol. % |

-continued

| | |
|---|---|
| Fumaric acid | 43 mol. % |
| 1,2,5-Hexanetricarboxylic acid | 2 mol. % |

The above ingredients were subjected to polycondensation with dibutyltin oxide as the catalyst under nitrogen stream at 200° C. The reaction was terminated at a point of providing a softening point of 95° C. to provide Polyester resin (III), which showed an acid value (AV) of 0.8 mgKOH/g and a glass transition temperature (Tg) of 58.1° C.

[Polyester resin Synthesis Example 4]

| | |
|---|---|
| Polyoxypropylene(2,2)-2,2-bis(4-hydroxyphenyl)propane | 49 mol. % |
| Terephthalic acid | 49 mol. % |
| 2,5,7-Naphthalenetricarboxylic acid | 2 mol. % |

The above ingredients were subjected to polycondensation with dibutyltin oxide as the catalyst under nitrogen stream at 200° C. The reaction was terminated at a point of providing a softening point of 92° C. to provide Polyester resin (IV), which showed an acid value (AV) of 17.1 mgKOH/g and a glass transition temperature (Tg) of 57° C.

[Polyester resin Synthesis Example 5]

| | |
|---|---|
| Polyoxypropylene(2,2)-2,2-bis(4-hydroxyphenyl)propane | 45 mol. % |
| Fumaric acid | 45 mol. % |
| 1,2,7,8-Octanetetracarboxylic acid | 2 mol. % |

The above ingredients were subjected to polycondensation with dibutyltin oxide as the catalyst under nitrogen stream at 200° C. The reaction was terminated at a point of providing a softening point of 95° C. to provide Polyester resin (V), which showed an acid value (AV) of 2.2 mgKOH/g and a glass transition temperature (Tg) of 59° C.

[Polyester resin Synthesis Example 6]

| | |
|---|---|
| Polyoxypropylene(2,2)-2,2-bis(4-hydroxyphenyl)propane | 50 mol. % |
| Terephthalic acid | 49.5 mol. % |
| Trimellitic anhydride | 0.5 mol. % |

The above ingredients were subjected to polycondensation with dibutyltin oxide as the catalyst under nitrogen stream at 200° C. The reaction was terminated at a point of providing a softening point of 103° C. to provide Polyester resin (VI), which showed an acid value (AV) of 8.7 mgKOH/g and a glass transition temperature (Tg) of 61° C.

(Toner Production Example 7)

| | |
|---|---|
| Polyester resin (I) | 100 parts |
| Phthalocyanine pigment | 4 parts |
| Di-tert-butylsalicylic acid metal complex | 4 parts |

The above ingredients were sufficiently preliminarily blended with each other by a Henschel mixer and melt-kneaded through a twin-screw extruder kneader. After cooling, the kneaded product was coarsely crushed into ca. 1–2 mm and finely pulverized by an air jet pulverizer, followed by classification to obtain blue powder (toner particles) having a weight-average particle size ($D_4$) of 5.8 μm.

100 parts of the above powder was blended by a Henschel mixer with 1.5 parts of hydrophobic alumina fine powder ($D_4$=0.02 μm, hydrophobicity ($H_{MeOH}$)=65 %) hydrophobized through treatment with 20 parts of iso—$C_4H_9$—Si—$(OCH_3)_3$ in aqueous medium, thereby to obtain Cyan Toner f.

The toner showed an acid value (AV) of 9.5 mgKOH/g, Tm=90° C. and Tg=55° C.

(Toner Production Example 8)

Cyan Toner g was prepared in the same manner as in Toner Production Example 7 except for using hydrophobic titanium oxide fine powder ($D_4$=0.03 μm, $H_{MeOH}$=60%) prepared by hydrophobizing titanium oxide fine powder with n—$C_4H_9$—Si—$(OH_3)_3$.

Toner g showed the same AV, Tm and Tg as Toner f.

(Toner Production Examples 9–13)

Toners h–l were prepared in the same manner as in Toner Production Example 7 except for using Polyester resins (II)–(VI) instead of Polyester resin (I).

Characterizing data of Toners f–l are summarized in the following Table 4.

TABLE 4

| Toner | Polyester | Additive | $D_4$ (μm) | Acid value (KOHmg/g) | Tm (°C.) | Tg (°C.) |
|---|---|---|---|---|---|---|
| f | (I) | $Al_2O_3$ | 5.8 | 9.5 | 90 | 55 |
| g | (I) | $TiO_2$ | 5.8 | 9.5 | 90 | 55 |
| h | (II) | $Al_2O_3$ | 6.1 | 22.0 | 88 | 54 |
| i | (III) | $Al_2O_3$ | 5.6 | 0.8 | 93 | 56 |
| j | (IV) | $Al_2O_3$ | 6.0 | 17.1 | 91 | 56 |
| k | (V) | $Al_2O_3$ | 5.8 | 2.2 | 93 | 57 |
| l | (VI) | $Al_2O_3$ | 5.9 | 8.7 | 100 | 60 |

Example 17

A two component-type developer (toner concentration ($C_{toner}$)=7 wt. %) was prepared by blending the above-prepared Cyan Toner f and Carrier 16, and subjected to continuous image formation by using a color copying machine ("CLC 700", mfd. by Canon K. K.) including an image-bearing member (I) having a protective layer containing 30 wt. % of fluorine-containing resin particles and using an intermittent alternating electric field shown in FIG. 4 under a developing contrast of 300 volts for reproducing an original having an image area ratio of 25%. The continuous image formation was performed on 10000 sheets for each of normal temperature/normal humidity (23° C./65%) conditions, high temperature/high humidity (30° C./80% RH) conditions and normal temperature/low humidity (20° C./10% RH) conditions. The results are shown in Table 5 appearing hereinafter.

Examples 18–22

Two component-type developers were prepared in the same manner as in Example 17 except for using Cyan Toners g–k instead of Cyan toner f. The resultant developers were evaluated in the same manner as in Example 17. The results are also shown in Table 5.

The developers of Examples 19 and 20 containing Toner h having a high acid value and Toner j having a low acid value showed somewhat inferior toner scattering than those of Examples 17 and 18 but were at a level of practically no problem.

Example 23

A two component-type developer was prepared and evaluated in the same manner as in Example 17 except for using Toner l instead of Toner f. The resultant images showed a lower gloss and a somewhat lower image density, but generally good performances were exhibited as shown in Table 5.

the image density was somewhat lowered and the solid image uniformity was also somewhat lowered. However, they were at a level of practically no problem.

TABLE 5

Figure 2:
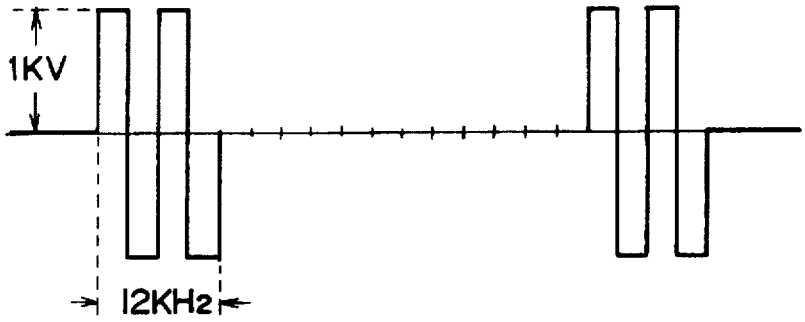
FIGS. 2–5 are diagrams showing alternating electric fields used in Examples 1, 13, 14 and 16, respectively, appearing hereinafter.

| Example | Carrier | Toner | $C_{toner}$ (%) | Image-bearing member | Electric field | Image density | Fog (%) | Durability (spent toner) | 30° C./80% toner scattering | 20° C./10% solid image uniformity |
|---|---|---|---|---|---|---|---|---|---|---|
| 17 | 16 | f | 7 | I | FIG. 4 | 1.6–1.7 | 1.2 | ⊙ | ⊙ | ⊙ |
| 18 | 16 | g | 7 | I | " | 1.7–1.8 | 1.2 | ⊙ | ⊙ | ⊙ |
| 19 | 16 | h | 7 | I | " | 1.6–1.8 | 1.5 | ○ | Δ | ○ |
| 20 | 16 | i | 7 | I | " | 1.6–1.7 | 1.5 | ○ | Δ | Δ |
| 21 | 16 | j | 7 | I | " | 1.6–1.7 | 1.3 | ⊙ | ○ | ⊙ |
| 22 | 16 | k | 7 | I | " | 1.5–1.7 | 1.3 | ⊙ | ○ | ○ |
| 23 | 16 | l | 7 | I | " | 1.5–1.6 | 1.2 | ⊙ | ⊙ | ○ |
| 24 | 17 | f | 7 | I | " | 1.6–1.7 | 1.3 | ⊙ | ⊙ | ⊙ |
| 25 | 18 | f | 7 | I | " | 1.6–1.7 | 1.2 | ⊙ | ⊙ | ○ |
| 26 | 19 | f | 7 | I | " | 1.6–1.7 | 1.3 | ⊙ | ○ | ⊙ |
| 27 | 20 | f | 7 | I | " | 1.6–1.8 | 1.3 | ○ | ○ | ⊙ |
| 28 | 16 | f | 7 | II | " | 1.6–1.7 | 1.2 | ⊙ | ⊙ | ⊙ |
| 29 | 16 | f | 7 | III | " | 1.5–1.6 | 1.1 | ⊙ | ⊙ | ○ |
| 30 | 16 | f | 7 | IV | " | 1.5–1.6 | 1.1 | ⊙ | ⊙ | Δ |
| 31 | 16 | f | 7 | I | FIG. 6 | 1.6–1.7 | 1.2 | ⊙ | ⊙ | ○ |
| 32 | 16 | f | 7 | I | FIG. 2 | 1.6–1.7 | 1.3 | ⊙ | ⊙ | ⊙ |
| 33 | 16 | f | 7 | I | FIG. 3 | 1.4–1.5 | 1.5 | ⊙ | ⊙ | Δ |

The manner of performance evaluation and the evaluation standards are supplemented at the end of this specification.

Examples 24–26

Two component-type developers were prepared and evaluated in the same manner as in Example 17 except for using Carriers 17–19 instead of Carrier 16. Generally good performances were exhibited as shown in Table 5.

Example 27

A two component-type developer was prepared and evaluated in the same manner as in Example 17 except for using Carrier 20 instead of Carrier 16. The successive image forming characteristic was somewhat inferior since the coating resin was not of the silicone-type, but generally good performances were exhibited as shown in Table 5.

Examples 28–30

The image forming test was performed in the same manner as in Example 17 except that the image-bearing member (I) was replaced by image-bearing members (II)–(IV) having protective layers containing 20%, 6% and 0%, respectively, of the fluorine-containing resin particles. The results are also shown in Table 5. As the content of the fluorine-containing resin particles was decreased, the uniformity of the solid image part became somewhat inferior but it was at a level of practically no problem.

Examples 31 and 32

The image forming test was performed in the same manner as in Example 17 except that the alternating electric field was changed from the one shown in FIG. 4 to those shown in FIGS. 5 and 2, respectively. Good results as shown in Table 5 were attained.

Examples 33

The image forming test was performed in the same manner as in Example 17 except that a continuous alternating electric field as shown in FIG. 3 was used. As a result, Some items of performance evaluation shown in Tables 2 and 5 were performed in the following manner.

[Image density]

Image density (I.D.) was evaluated by a reflective densitometer ("RD-918", mfd. by Macbeth Co.) and indicated according to the following standard.

⊙ (excellent): I.D.=1.6–1.7

○ (good):>1.7–1.8 or 1.45–<1.6

Δ (fair):>1.8–1.9 or 1.3–<1.45 x (poor):>1.9 or <1.3

[Fog]

Fog was evaluated by measurement of the reflectance by using a reflectometer ("MODEL TC-6DS", mfd. by Tokyo Denshoku K. K.) and an amber filler for cyan toner images. Fog was calculated by the following equation.

Fog (%)=reflectance on standard paper (%)–reflectance at a non-image portion on a recorded sample sheet (%).

A smaller value means less fog, and the evaluation standard is as follows:

⊙: 0–1.2%

○: >1.2%–1.6%

Δ: >1.6%–1.9% x:>1.9%

[Durability (spent toner)]

The carriers after the continuous image formation were observed though a scanning electron microscope at a magnification of 2000.

⊙: No spent toner (toner melt-sticking) was observed. No charge decreased was observed.

○: Slight spent toner observed. No charge decrease.

Δ: Noticeable spent toner observed at concavities, but little decrease in charge.

x: Spent toner observed on the entirety. A substantial charge decrease.

[Toner scattering]

Toner scattering was evaluated by checking the degree of soiling with toner on the outer surfaces of the upstream toner scattering-preventing member (21 in FIG. 1 an 103 in FIG. 7) and the downstream toner scattering-preventing member (22 in FIG. 1 and 104 in FIG. 7) of the developing device, and on the members other than the developing device in the image forming apparatus. Evaluation results are indicated according to the following standard:

○: No soiling was recognized at all.

◐: Slight soiling was recognized on the water surface of the upstream toner scattering-preventing member but not on the downstream toner scattering preventing member.

Δ: Soiling was recognized on the outer surfaces of the upstream and downstream toner scattering-preventing members, but no soiling was observed on the members other than the developing device.

x: Soiling was observed on the members other than the developing device.

[Uniformity of solid images]

Solid image formed on CLC-SK paper (standard paper for "CLC" copier) was observed with respect to the occurrence of irregularity after standing.

⊙: No problem at all after standing for 1 week.

◐: No problem after standing for 3 days.

Δ: No problem after standing overnight.

x: Irregularity observed after standing overnight.

[Softening temperature (Tm)]

A flow tester ("Model CFT-500", mfd. by Shimazu Seisakusho K. K.) was used. Ca. 1 g of a sample having passed 60 mesh was weighed and compressed for 1 min. under a pressure of 100 kg/cm The compressed sample was subjected to measurement in the flow tester under conditions shown below and under normal temperature/normal humidity conditions (ca. 20°–30° C./30–70% RH) to obtain a temperature-apparent viscosity curve. From a smoothened curve, a temperature ($=T_{1/2}$) at a time when half a volume of the sample was flown out was measured and taken as a softening temperature (Tm).

| | |
|---|---|
| RATE TEMP | 6.0 DEG (%)/M |
| SET TEMP | 50.0 DEG (°C.) |
| MAX TEMP | 180.0 DEG |
| INTERVAL | 3.0 DEG |
| PREHEAT | 300.0 SEC |
| LOAD | 20.0 KGF (kg) |
| DIE (DIA) | 1.0 MM (mm) |
| DIE (LENG) | 1.0 MM |
| PLUNGER | 1.0 $CM^2$ ($cm^2$) |

What is claimed is:

1. A carrier for electrophotography, comprising: magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad \text{(I)},$$

wherein A denotes a member selected from the group consisting of MgO, AgO and mixtures thereof; B denotes a member selected from the group consisting of MnO, CaO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$.

2. The carrier according to claim 1, wherein x, y and z in the formula (I) further satisfying the conditions of: $x+y<1$ and $z=1-x-y$.

3. The carrier according to claim 1, wherein said carrier core particles contain 0.5–30 wt. % of MgO calculated as its oxide form.

4. The carrier according to claim 2, wherein said carrier core particles contain 0.5–30 wt. % of MgO calculated as its oxide form.

5. The carrier according to claim 1, wherein the component B in the formula (I) is selected from the group consisting of MnO, CaO, and mixtures thereof.

6. The carrier according to claim 1, wherein the carrier has a 50%-particle size of 15–60 μm, and contain 1–20 wt. % of carrier particles of below 22 μm, 0.01–3 wt. % of carrier particles of below 16 μm, 2–20 wt. % of carrier particles of at least 62 μm, and at most 3 wt. % of carrier particles of at least 88 μm.

7. The carrier according to claim 2, wherein the carrier has a 50%-particle size of 15–60 μm, and contain 1–20 wt. % of carrier particles of below 22 μm, 0.01–3 wt. % of carrier particles of below 16 μm, 2–20 wt. % of carrier particles of at least 62 μm, and at most 3 wt. % of carrier particles of at least 88 μm.

8. The carrier according to claim 1, wherein the carrier has a specific area ratio $S_1/S_2$ of 1.2–2.0, wherein $S_1$ represents a specific surface area measured by the air permeation method and $S_2$ denotes a specific surface area calculated by the following formula (II):

$$S_2=[6/(\rho \times D_{50})] \times 10^4 \quad \text{(II)},$$

wherein ρ denotes a density and $D_{50}$ denotes a 50%-particle size, respectively, of the carrier.

9. The carrier according to claim 8, wherein the carrier has an $S_1/S_2$ ratio of 1.3–1.8.

10. The carrier according to claim 1, wherein the carrier has an apparent density of 1.2–3.2 $g/cm^3$.

11. The carrier according to claim 1, wherein the carrier has an apparent density of 1.5–2.8 $g/cm^3$.

12. The carrier according to claim 1, wherein the carrier has a current value of 20–300 μA.

13. The carrier according to claim 1, wherein the carrier has a current value of 20–250 μA.

14. The carrier according to claim 1, wherein the resin coating layer comprises a reactive silicone resin containing a curing agent represented by the following formula (III):

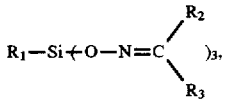

(III)

wherein $R_1$ denotes a substituent selected from the group consisting of $CH_3$, $C_2H_5$ and

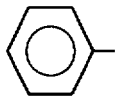

each capable of having a substituent; and $R_2$ and $R_3$ independently denote $CH_3$ and $C_2H_5$ each capable of having a substituent.

15. The carrier according to claim 2, wherein the resin coating layer comprises a reactive silicone resin containing a curing agent represented by the following formula (III):

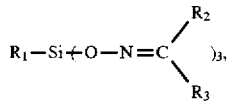

(III)

wherein $R_1$ denotes a substituent selected from the group consisting of $CH_3$, $C_2H_5$ and

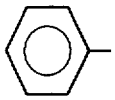

each capable of having a substituent; and $R_2$ and $R_3$ independently denote $CH_3$ and $C_2H_5$ each capable of having a substituent.

16. The carrier according to claim 1, wherein the resin coating layer comprises a reactive silicone resin containing an aminosilane coupling agent.

17. The carrier according to claim 16, wherein the amino silane coupling agent is a member selected from the group consisting of:

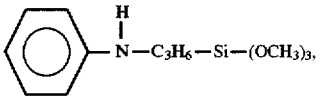

$H_5C_2-N(H)-C_3H_6-Si-(OCH_3)_3$, $H_2N-C_3H_6-Si-(OCH_3)_3$, $H_2N-C_2H_4-N(H)-C_3H_6-Si-(OCH_3)_3$, $H_9C_4-N(H)-C_3H_6-Si-(OCH_3)_3$, $H_2N-C_2H_4-NH-C_3H_6-Si(CH_3)-(OCH_3)_3$, $(C_2H_5)_2-N-C_3H_6-Si-(OCH_3)_3$, $(C_4H_9)_2-N-C_3H_6-Si-(OCH_3)_3$, and

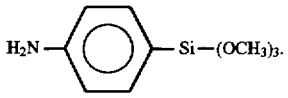

18. The carrier according to claim 16, wherein the reactive silicone resin contains 0.1–8 wt. parts of the aminosilane coupling agent per 100 wt. parts of siloxane solid matter.

19. The carrier according to claim 16, wherein the reactive silicone resin contains 0.3–5 wt. parts of the aminosilane coupling agent per 100 wt. parts of siloxane solid matter.

20. The carrier according to claim 16, wherein the reactive silicone resin further contains a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

21. The carrier according to claim 20, wherein the coupling agent is a member selected from the groups consisting of:

$CH_3=CH-Si-(OCH_3)_3$, $CH_3-Si-(OCH_3)_3$, and $CH_3-Si-(OC_2H_5)_3$.

22. The carrier according to claim 1, wherein the resin coating layer comprises a reactive silicone resin containing:

a curing agent represented by the following formula (III):

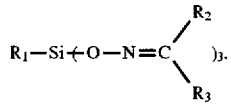

(III)

wherein $R_1$ denotes a substituent selected from the group consisting of $CH_3$, $C_2H_5$ and

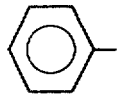

each capable of having a substituent; and $R_2$ and $R_3$ independently denote $CH_3$ and $C_2H_5$ each capable of having a substituent;

an aminosilane coupling agent; and a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

23. A two component-type developer, comprising: a toner comprising toner particles, and a carrier comprising magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad \text{(I)},$$

wherein A denotes a member selected from the group consisting of MgO, AgO and mixtures thereof; B denotes a member selected from the group consisting of MnO, CaO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$.

24. The developer according to claim 23, wherein x, y and z in the formula (I) further satisfying the condition of $x+y<1$ and $z=1-x-y$;

the toner comprises toner particles and an external additive;

the toner has a weight-average particle size of 1–9 μm; and the external additive comprises surface treated inorganic fine particles having a weight-average particle size of 0.001–0.2 μm.

25. The developer according to claim 23, wherein x, y and z in the formula (I) further satisfy the conditions of:

$x+y<1$ and $z=1-x-y$.

26. The developer according to claim 23, wherein said carrier core particles contain 0.5–30 wt. % of MgO calculated as its oxide form.

27. The developer according to claim 24, wherein said carrier core particles contain 0.5–30 wt. % of MgO calculated as its oxide form.

28. The developer according to claim 23, wherein the component B in the formula (I) is selected from the group consisting of MnO, CaO, and mixtures thereof.

29. The developer according to claim 23, wherein the carrier has a 50%-particle size of 15–60 μm, and contain 1–20 wt. % of carrier particles of below 22 μm, 0.01–3 wt. % of carrier particles of below 16 μm, 2–20 wt. % of carrier particles of at least 62 μm, and at most 3 wt. % of carrier particles of at least 88 μm.

30. The developer according to claim 24, wherein the carrier has a 50%-particle size of 15–60 μm, and contain 1–20 wt. % of carrier particles of below 22 μm, 0.01–3 wt. % of carrier particles of below 16 μm, 2–20 wt. % of carrier particles of at least 62 μm, and at most 3 wt. % of carrier particles of at least 88 μm.

31. The developer according to claim 23, wherein the carrier has a specific area ratio $S_1/S_2$ of 1.2–2.0, wherein $S_1$ represents a specific surface area measured by the air permeation method and $S_2$ denotes a specific surface area calculated by the following formula (II):

$$S_2=|6/(\rho\times D_{50})|\times 10^4 \quad \text{(II)},$$

wherein ρ denotes a density and $D_{50}$ denotes a 50%-average particle size, respectively, of the carrier.

32. The developer according to claim 31, wherein the carrier has an $S_1/S_2$ ratio of 1.3–1.8.

33. The developer according to claim 23, wherein the carrier has an apparent density of 1.2–3.2 g/cm$^3$.

34. The developer according to claim 23, wherein the carrier has an apparent density of 1.5–2.8 g/cm$^3$.

35. The developer according to claim 23, wherein the carrier has a current value of 20–300 μA.

36. The developer according to claim 23, wherein the carrier has a current value of 20–250 μA.

37. The developer according to claim 23, wherein the resin coating layer comprises a reactive silicone resin containing a curing agent represented by the following formula (III):

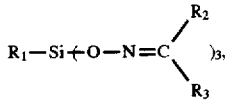

(III)

wherein $R_1$ denotes a substituent selected from the group consisting of $CH_3$, $C_2H_5$ and

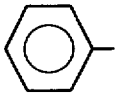

each capable of having a substituent; and $R_2$ and $R_3$ independently denote $CH_3$ and $C_2H_5$ each capable of having a substituent.

38. The developer according to claim 24, wherein the resin coating layer comprises a reactive silicone resin containing a curing agent represented by the following formula (III):

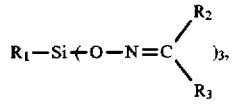

(III)

wherein $R_1$ denotes a substituent selected from the group consisting of $CH_3$, $C_2H_5$ and

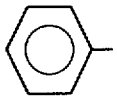

each capable of having a substituent; and $R_2$ and $R_3$ independently denote $CH_3$ and $C_2H_5$ each capable of having a substituent.

39. The developer according to claim 23, wherein the resin coating layer comprises a reactive silicone resin containing an aminosilane coupling agent.

40. The developer according to claim 39, wherein the amino silane coupling agent is a member selected from the group consisting of:

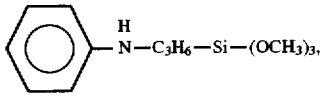

$H_5C_2-\overset{H}{N}-C_3H_6-Si-(OCH_3)_3$, $H_2N-C_3H_6-Si-(OCH_3)_3$, $H_2N-C_2H_4-\overset{H}{N}-C_3H_6-Si-(OCH_3)_3$, $H_9C_4-\overset{H}{N}-C_3H_6-Si-(OCH_3)_3$, $H_2N-C_2H_4-NH-C_3H_6-\underset{\underset{CH_3}{|}}{Si}-(OCH_3)_3$, $(C_2H_5)_2-N-C_3H_6-Si-(OCH_3)_3$, $(C_4H_9)_2-N-C_3H_6-Si-(OCH_3)_3$, and

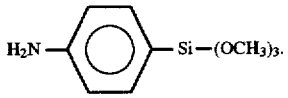

41. The developer according to claim 39, wherein the reactive silicone resin contains 0.1–8 wt. parts of the aminosilane coupling agent per 100 wt. parts of siloxane solid matter.

42. The developer according to claim 39, wherein the reactive silicone resin contains 0.3–5 wt. parts of the aminosilane coupling agent per 100 wt. parts of siloxane solid matter.

43. The developer according to claim 39, wherein the reactive silicone resin further contains a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

44. The developer according to claim 43, wherein the coupling agent is a member selected from the groups consisting of:

$CH_3=CH-Si-(OCH_3)_3$, $CH_3-Si-(OCH_3)_3$, and $CH_3-Si-(OC_2H_5)_3$.

45. The developer according to claim 23, wherein the resin coating layer comprises a reactive silicone resin containing:

a curing agent represented by the following formula (III):

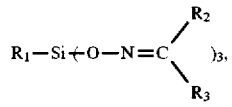

(III)

wherein $R_1$ denotes a substituent selected from the group consisting of $CH_3$, $C_2H_5$ and

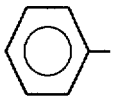

each capable of having a substituent; and $R_2$ and $R_3$ independently denote $CH_3$ and $C_2H_5$ each capable of having a substituent;

an aminosilane coupling agent; and a coupling agent represented by the following formula (IV):

$$R_{4-a}—Si—X_a \quad (IV),$$

wherein R denotes a substituent selected from the group consisting of vinyl, methacryl, epoxy, amino, mercapto and derivatives of these; X denotes a halogen or alkoxy group; and a is an integer of 1–3.

46. The developer according to claim 23, wherein the toner has a weight-average particle size of 1–9 μm.

47. The developer according to claim 23, wherein the toner comprises toner particles, and an external additive comprising hydrophobic inorganic fine particles.

48. The developer according to claim 47, wherein the hydrophobic inorganic fine particles comprise at least one member selected from the group consisting of alumina fine particles, titanium oxide fine particles and silica fine particles.

49. The developer according to claim 47, wherein the hydrophobic inorganic fine particles have a hydrophobicity of 20–80%.

50. The developer according to claim 47, wherein the hydrophobic inorganic fine particles have a weight-average particle size of 0.001–0.2 μm.

51. The developer according to claim 47, wherein the hydrophobic inorganic fine particles have an optical transmittance of at least 40% at a wavelength of 400 nm.

52. The developer according to claim 23, wherein the toner particles comprise a binder resin and a colorant, and the binder resin comprises a polyester resin.

53. The developer according to claim 52, wherein the polyester resin comprises a condensation copolymer of an etherified bisphenol and a polycarboxylic acid having at least two functional groups.

54. The developer according to claim 53, wherein the etherified bisphenol comprises a compound represented by the following formula (V):

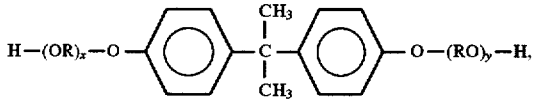

(V)

wherein R denotes an ethylene or propylene group, x and y are independently a positive integer of at least 1 with the proviso that the average of x+y is in the range of 2–10.

55. The developer according to claim 52, wherein the toner particles have an acid value of 1–20 mgKOH/g.

56. The developer according to claim 53, wherein said polycarboxylic acid includes 0.1–20 mol. % of a polycarboxylic acid component having at least three functional groups.

57. The developer according to claim 52, wherein the toner particles have a glass transition temperature (Tg) of 45°–47° C.

58. The developer according to claim 52, wherein the toner particles have a temperature providing an apparent viscosity of $10^5$ poises (Tm) in the range of 80°–120° C.

59. An image forming method, comprising:

circulatively conveying a two component-type developer comprising a toner and a carrier on a developer-carrying member, and developing, in a developing region, an electrostatic latent image held on an electrostatic image-bearing member with the toner in the two component-type developer, wherein the toner comprises toner particles, and the carrier comprises magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of MnO, CaO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$.

60. The method according to claim 59, wherein the electrostatic latent image is developed with the toner in the two component-type developer while applying to the developer-carrying member a developing bias comprising an intermittent alternating current component to form a developing electric field between the electrostatic image-bearing member and the developer-carrying member.

61. The method according to claim 60, wherein the developing bias comprises a succession of voltages including (i) at least one cycle of a first voltage directing a toner from the image-bearing member toward the developer-carrying member and a second voltage directing the toner from the developer-carrying member towards the image-bearing member, and (ii) a third voltage at a substantially constant level intermediate between those of the first and second voltages, wherein a period ($T_1$) for applying said at least one cycle of the first and second voltages is shorter than a period ($T_2$) for applying the third voltage.

62. The method according to claim 59, wherein said electrostatic latent image-holding member comprises a photosensitive layer and a protective layer coating the photosensitive layer; the protective layer containing fluorine-containing resin particles.

63. The method according to claim 59, wherein said protective layer has a ten point average surface roughness (Rz) of 0.01–1.5 μm.

64. The method according to claim 59, wherein the two component-type developer comprises a developer according to any of claims 24–57.

65. The carrier according to claim 1, wherein the carrier has a 50%-particle size of 15–60 μm and contains 1–20 wt. % of carrier particles below 22 μm, 0–3 wt. % of carrier particles below 16 μm, 2–20 wt. % of carrier particles of at least 62 μm and at most 3 wt. % of carrier particles of at least 88 μm.

66. The developer according to claim 23, wherein the carrier has a 50%-particle size of 15–60 μm and contains 1–20 wt. % of carrier particles of below 22 μm, 0–3 wt. % of carrier particles below 16 μm, 2–20 wt. % of carrier particles of at least 62 μm and at most 3 wt. % of carrier particles of at least 88 μm.

67. An image forming method, comprising:

circulatively conveying a two component-type developer comprising a toner and a carrier on a developer-carrying member, and developing, in a developing region, an electrostatic latent image held on an electrostatic image-bearing member with the toner in the two component-type developer, while applying to the developer-carrying member a developing bias comprising an intermittent alternating current component to form a developing electric field between the electrostatic image-bearing member and the developer-carrying member, wherein the toner comprises toner particles, and the carrier comprises magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of $Li_2O$, MnO, CaO, SrO, $Al_2O_3$, $Sio_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$, and the resin coating layer comprises a reactive silicone resin.

68. The method according to claim 67, wherein the developing bias comprises a succession of voltages including (i) at least one cycle of a first voltage directing a toner from the image-hearing member toward the developer-carrying member and a second voltage directing the toner from the developer-carrying member toward the image-bearing member, and (ii) a third voltage at a substantially constant level intermediate between those of the first and second voltages; wherein a period ($T_1$) for applying said at least one cycle of the first and second voltages is shorter than a period ($T_2$) for applying the third voltage.

69. The method according to claim 67, wherein said electrostatic latent image-holding member comprises a photosensitive layer and a protective layer coating the photosensitive layer; the protective layer containing fluorine-containing resin particles.

70. The method according to claim 67, wherein said protective layer has a ten point average surface roughness (Rz) of 0.01–1.5 μm.

71. The method according to claim 67, wherein the developing bias comprises a superposition of a direct current component with the intermittent alternating current component.

72. The method according to claim 67, wherein the alternating current component comprises substantially rectangular waves.

73. The method according to claim 67, wherein x, y and z in the formula (I) further satisfy the conditions of:

$x+y<1$ and $z=1-x-y$.

74. The method according to claim 67, wherein x, y and z in the formula (I) further satisfy the condition of $x+y<1$ and $z=1-x-y$;

the toner comprises toner particles and an external additive;

the toner has a weight-average particle size of 1–9 μm; and the external additive comprises surface-treated inorganic fine particles having a weight-average particle size of 0.001–0.2 μm.

75. The method according to claim 67, wherein said carrier core particles contain 0.5–30 wt. % of MgO calculated as its oxide form.

76. The method according to claim 67, wherein the carrier has a 50%-particle size of 15–60 μm and contains 1–20 wt. % of carrier particles of below 22 μm, 0–3 wt. % of carrier particles below 16 μm, 2–20 wt. % of carrier particles of at least 62 μm and at most 3 wt. % of carrier particles of at least 88 μm.

77. The method according to claim 67, wherein the carrier has a specific area ratio $S_1/S_2$ of 1.2 -2.0, wherein $S_1$ represents a specific surface area measured by the air permeation method and $S_2$ denotes a specific surface area calculated by the following formula (II):

$$S_2=[6/(\rho \times D_{50})] \times 10^4 \quad (II),$$

wherein ρ denotes a density and $D_{50}$ denotes a 50%-average particle size, respectively, of the carrier.

78. The method according to claim 77, wherein the carrier has an $S_1/S_2$ ratio of 1.3–1.8.

79. The method according to claim 67, wherein the carrier has an apparent density of 1.2–3.2 g/cm$^3$.

80. The method according to claim 67, wherein the carrier has an apparent density of 1.5–2.8 g/cm$^3$.

81. The method according to claim 67, wherein the carrier has a current value of 20–300 μA.

82. The method according to claim 67, wherein the carrier has a current value of 20–250 μA.

83. The method according to claim 67, wherein the resin coating layer comprises the reactive silicone resin containing a curing agent represented by the following formula (III):

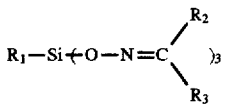

(III)

wherein $R_1$ denotes a substituent selected from the group consisting of $CH_3$, $C_2H_5$ and

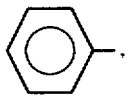

each capable of having a substituent; and $R_2$ and $R_3$ independently denote $CH_3$ and $C_2H_5$, each capable of having a substituent.

84. The method according to claim 67, wherein the resin coating layer comprises the reactive silicone resin containing an aminosilane coupling agent.

85. The method according to claim 84, wherein the aminosilane coupling agent is a member selected from the group consisting of:

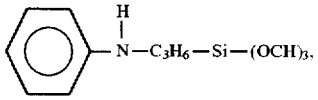

$H_5C_2-\overset{H}{\overset{|}{N}}-C_3H_6-Si-(OCH_3)_3$, $H_2N-C_3H_6-Si-(OCH_3)_3$, $H_2N-C_2H_4-\overset{H}{\overset{|}{N}}-C_3H_6-Si-(OCH_3)_3$, $H_9C_4-\overset{H}{\overset{|}{N}}-C_3H_6-Si-(OCH_3)_3$, $H_2N-C_2H_4-NH-C_3H_6-\underset{\underset{CH_3}{|}}{Si}-(OCH_3)_3$, $(C_2H_5)_2-N-C_3H_6-Si-(OCH_3)_3$, $(C_4H_9)_2-N-C_3H_6-Si-(OCH_3)_3$, and

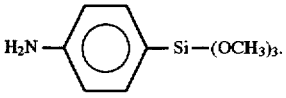

86. The method according to claim 84, wherein the reactive silicone resin contains 0.1–8 wt. parts of the aminosilane coupling agent per 100 wt. parts of siloxane solid matter.

87. The method according to claim 84, wherein the reactive silicone resin contains 0.3–5 wt. parts of the aminosilane coupling agent per 100 wt. parts of siloxane solid matter.

88. The method according to claim 84, wherein the reactive silicone resin further contains a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

89. The method according to claim 88, wherein the coupling agent is a member selected from the group consisting of:

$CH_3=CH-Si-(OCH_3)_3$, $CH_3-Si-(OCH_3)_3$, and $CH_3-Si-(OC_2H_5)_3$.

90. The method according to claim 88, wherein the resin coating layer comprises a reactive silicone resin containing:

a curing agent represented by the following formula (III):

$$R_1-Si\left(O-N=C\begin{matrix}R_2\\R_3\end{matrix}\right)_3, \quad \text{(III)}$$

wherein $R_1$ denotes a substituent selected from the group consisting of $CH_3$, $C_2H_5$ and

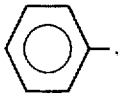

each capable of having a substituent; and $R_2$ and $R_3$ independently denote $CH_3$ and $C_2H_5$, each capable of having a substituent;

an aminosilane coupling agent;

and a coupling agent represented by the following formula (IV):

$$R_{4-a}-Si-X_a \quad \text{(IV)}$$

wherein R denotes a substituent selected from the group consisting of vinyl, methacryl, epoxy, amino, mercapto and derivatives of these; X denotes a halogen or alkoxy group; and a is an integer of 1–3.

91. The method according to claim 67, wherein the toner has a weight-average particle size of 1–9 μm.

92. The method according to claim 67, wherein the toner comprises toner particles, and an external additive comprising hydrophobic inorganic fine particles.

93. The method according to claim 92, wherein the hydrophobic inorganic fine particles comprise at least one member selected from the group consisting of alumina fine particles, titanium oxide fine particles and silica fine particles.

94. The method according to claim 92, wherein the hydrophobic inorganic fine particles have a hydrophobicity of 20–80%.

95. The method according to claim 92, wherein the hydrophobic inorganic fine particles have a weight-average particle size of 0.001–0.2 μm.

96. The method according to claim 92, wherein the hydrophobic inorganic fine particles have an optical transmittance of at least 40% at a wavelength of 400 nm.

97. The method according to claim 67, wherein the toner particles comprise a binder resin and a colorant, and the binder resin comprises a polyester resin.

98. The method according to claim 97, wherein the polyester resin comprises a condensation copolymer of an etherified bisphenol and a polycarboxylic acid having at least two functional groups.

99. The method according to claim 98, wherein the etherified bisphenol comprises a compound represented by the following formula (V):

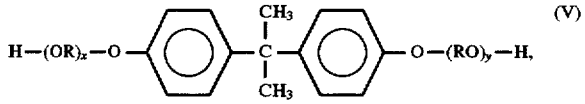

(V)

wherein R denotes an ethylene or propylene group, x and y are independently a positive integer of at least 1 with a proviso that the average of x+y is in the range of 2–10.

100. The method according to claim 97, wherein the toner particles have an acid value of 1–20 mg KOH/g.

101. The method according to claim 98, wherein said polycarboxylic acid includes 0.1–20 mol. % of a polycarboxylic acid component having at least three functional groups.

102. The method according to claim 97, wherein the toner particles have a glass transition temperature (Tg) of 45°–47° C.

103. The method according to claim 97, wherein the toner particles have a temperature providing an apparent viscosity of $10^5$ poises (Tm) in the range of 80°–120° C.

104. An image forming method, comprising:

circulatively conveying a two component-type developer comprising a toner and a carrier on a developer-carrying member, and developing, in a developing region, an electrostatic latent image held on an electrostatic image-bearing member with the toner in the two component-type developer, while applying to the developer-carrying member a developing bias comprising an intermittent alternating current component to form a developing electric field between the electrostatic image-bearing member and the developer-carrying member, wherein the toner comprises toner particles, and the carrier comprises magnetic carrier core particles and a resin coating layer coating the magnetic carrier core particles, wherein the carrier core particles comprise a magnetic ferrite component represented by the following formula (I):

$$(Fe_2O_3)_x(A)_y(B)_z \quad (I),$$

wherein A denotes a member selected from the group consisting of MgO, AgO and mixtures thereof; B denotes a member selected from the group consisting of $Li_2O$, MnO, CaO, SrO, $Al_2O_3$, $SiO_2$ and mixtures thereof; and x, y and z are numbers representing weight ratios and satisfying the relation of: $0.2 \leqq x \leqq 0.95$, $0.005 \leqq y \leqq 0.3$, $0 < z \leqq 0.795$, and $x+y+z \leqq 1$, and the resin coating layer comprises a silicone resin having a reactive group.

105. The method according to claim 104 wherein the reactive group is a hydrolyzable reactive group.

106. The method according to claim 105 wherein the hydrolyzable reactive group is attached to a silicon atom of the silicone resin and the hydrolyzable reactive group is selected from the group consisting of an oxime group, an alkoxy group and a halogen.

107. The method according to claim 104, wherein the developing bias comprises a succession of voltages including (i) at least one cycle of a first voltage directing a toner from the image-hearing member toward the developer-carrying member and a second voltage directing the toner from the developer-carrying member toward the image-bearing member, and (ii) a third voltage at a substantially constant level intermediate between those of the first and second voltages; wherein a period ($T_1$) for applying said at least one cycle of the first and second voltages is shorter than a period ($T_2$) for applying the third voltage.

108. The method according to claim 104, wherein said electrostatic latent image-holding member comprises a photosensitive layer and a protective layer coating the photosensitive layer; the protective layer containing fluorine-containing resin particles.

109. The method according to claim 104, wherein said protective layer has a ten point average surface roughness (Rz) of 0.01–1.5 μm.

110. The method according to claim 104, wherein the developing bias comprises a superposition of a direct current component with the intermittent alternating current component.

111. The method according to claim 104, wherein the alternating current component comprises substantially rectangular waves.

112. The method according to claim 104, wherein x, y and z in the formula (I) further satisfy the conditions of:

$x+y<1$ and $z=1-x-y$.

113. The method according to claim 104, wherein x, y and z in the formula (I) further satisfy the condition of $x+y<1$ and $z=1-x-y$;

the toner comprises toner particles and an external additive;

the toner has a weight-average particle size of 1–9 μm; and the external additive comprises surface-treated inorganic fine particles having a weight-average particle size of 0.001–0.2 μm.

114. The method according to claim 104, wherein said carrier core particles contain 0.5–30 wt. % of MgO calculated as its oxide form.

115. The method according to claim 104, wherein the carrier has a 50%-particle size of 15–60 μm and contains 1–20 wt. % of carrier particles of below 22 μm, 0–3 wt. % of carrier particles below 16 μm, 2–20 wt. % of carrier particles of at least 62 μm and at most 3 wt. % of carrier particles of at least 88 μm.

116. The method according to claim 104, wherein the carrier has a specific area ratio $S_1/S_2$ of 1.2–2.0, wherein $S_1$ represents a specific surface area measured by the air permeation method and $S_2$ denotes a specific surface area calculated by the following formula (II):

$$S_2=[6/(\rho \times D_{50})] \times 10^4 \quad (II),$$

wherein ρ denotes a density and $D_{50}$ denotes a 50%-average particle size, respectively, of the carrier.

117. The method according to claim 116, wherein the carrier has an $S_1/S_2$ ratio of 1.3–1.8.

118. The method according to claim 104, wherein the carrier has a current value of 20–300 μA.

119. The method according to claim 104, wherein the resin coating layer comprises the reactive silicone resin containing a curing agent represented by the following formula (III):

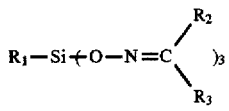

(III)

wherein $R_1$ denotes a substituent selected from the group consisting of $CH_3$, $C_2H_5$ and

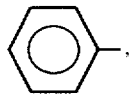

each capable of having a substituent; and $R_2$ and $R_3$ independently denote $CH_3$ and $C_2H_5$, each capable of having a substituent.

120. The method according to claim 104, wherein the resin coating layer comprises the reactive silicone resin containing an aminosilane coupling agent.

121. The method according to claim 120, wherein the aminosilane coupling agent is a member selected from the group consisting of:

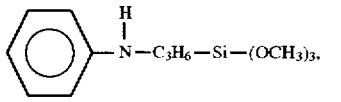

$H_5C_2-\overset{H}{\overset{|}{N}}-C_3H_6-Si-(OCH_3)_3$, $H_2N-C_3H_6-Si-(OCH_3)_3$, $H_2N-C_2H_4-\overset{H}{\overset{|}{N}}-C_3H_6-Si-(OCH_3)_3$, $H_9C_4-\overset{H}{\overset{|}{N}}-C_3H_6-Si-(OCH_3)_3$, $H_2N-C_2H_4-NH-C_3H_6-\underset{\underset{CH_3}{|}}{Si}-(OCH_3)_3$, $(C_2H_5)_2-N-C_3H_6-Si-(OCH_3)_3$, $(C_4H_9)_2-N-C_3H_6-Si-(OCH_3)_3$, and

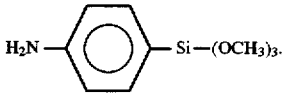

122. The method according to claim 120, wherein the reactive silicone resin further contains a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

123. The method according to claim 122, wherein the coupling agent is a member selected from the group consisting of:

$CH_3=CH-Si-(OCH_3)_3$, $CH_3-Si-(OCH_3)_3$, and $CH_3-Si-(OC_2H_5)_3$.

124. The method according to claim 122, wherein the resin coating layer comprises a reactive silicone resin containing:

a curing agent represented by the following formula (III):

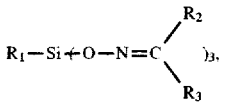

$$R_1-Si\leftarrow O-N=C\begin{matrix}R_2\\R_3\end{matrix}\Big)_3, \quad \text{(III)}$$

wherein $R_1$ denotes a substituent selected from the group consisting of $CH_3$, $C_2H_5$ and

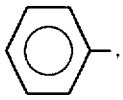

each capable of having a substituent; and $R_2$ and $R_3$ independently denote $CH_3$ and $C_2H_5$, each capable of having a substituent;

an aminosilane coupling agent;

and a coupling agent represented by the following formula (IV):

$$R_{4-a}-Si-X_a \quad \text{(IV)},$$

wherein R denotes a substituent selected from the group consisting of vinyl, methacryl, epoxy, amino, mercapto and derivatives of these; X denotes a halogen or alkoxy group; and a is an integer of 1–3.

125. The method according to claim 104, wherein the toner has a weight-average particle size of 1–9 μm.

126. The method according to claim 104, wherein the toner comprises toner particles, and an external additive comprising hydrophobic inorganic fine particles.

127. The method according to claim 126, wherein the hydrophobic inorganic fine particles comprise at least one member selected from the group consisting of alumina fine particles, titanium oxide fine particles and silica fine particles.

128. The method according to claim 126, wherein the hydrophobic inorganic fine particles have a hydrophobicity of 20–80%.

129. The method according to claim 126, wherein the hydrophobic inorganic fine particles have a weight-average particle size of 0.001–0.2 μm.

130. The method according to claim 126, wherein the hydrophobic inorganic fine particles have an optical transmittance of at least 40% at a wavelength of 400 nm.

* * * * *

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

ON COVER PAGE AT [56] REFERENCES, FOREIGN PATENT DOCS.

"60-208767 10/1995" should read --60-208767 10/1985--.

ON COVER PAGE AT [56] REFERENCES, OTHER PUBLICATIONS

"JP-A-123550" should read --JP-A-58-123550--.

COLUMN 2

Line 4, "himidity." should read --humidity.--;
LINE 27, "Futher " should read --futher, --.

COLUMN 3

Line 4, "of" should be deleted.

COLUMN 4

Line 3, "reason," should read --reasons,--;
Line 13, "a" (first occurrence) should read --an--.
Line 12, "an" should read --a--.

COLUMN 5

Line 59, "however" should read --however,--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 6

Line 6 "copins" should read --coping--.

COLUMN 7

Line 47, "proposes," should read --purposes,--.

COLUMN 8

Line 4, "conditions::" should read --conditions:--;
Line 6, "SrO" should read --SrO,--.

COLUMN 9

Line 28, "is" should read --is present--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 11

Formula 10, line 52, " $-\underset{\underset{CH_3}{|}}{Si}-(OCH_3)_3$, " should read -- $-\underset{\underset{CH_3}{|}}{Si}-(OCH_3)_2$, --.

COLUMN 12

Formula 10, line 17, " $-\underset{\underset{CH_3}{|}}{Si}-(OCH_3)_3$, " should read -- $-\underset{\underset{CH_3}{|}}{Si}-(OCH_3)_2$, --.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 13

Line 50, "hydrophobicity" should read --hydrophobicity is--.

COLUMN 14

Line 18, "respects" should read --respect--.

COLUMN 15

Line 66, "$10_5$" should read --$10^5$--.

COLUMN 16

Line 34, "an" should read --a--.

COLUMN 18

Line 45, "include;" should read --include:--.

COLUMN 20

Line 58, "if" should read --it--.

COLUMN 22

Line 35, "even if" should read --if--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 23

Line 27, "fore" should read --force--.

COLUMN 24

Line 31, "power" should read --powder--.

COLUMN 26

Line 51, "($\sigma$=60" should read --($\sigma$s=60--.

COLUMN 27

Line 5, "≦1 g/100 ml)" should read --≧1 g/100 ml)--.

COLUMN 28

Line 5, "$CH_3$—Si(O—N " should read --$CH_3$—Si—(O—N --;
Line 9, "parts," should read --parts--;
Line 38, "agent" should read --agent)--.

COLUMN 29

Line 40, "HMeOH=50%" should read --$H_{MeOH}$=50%--;
Line 61, "by through" should read --by--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 30

Line 17, "alternating-electric" should read --alternating electric--.

COLUMN 31

Line 57, "a" should read --an--.

TABLE 5

Ex. 31, "FIG. 6" should read --FIG. 5--.

COLUMN 39

Line 31, "kg/cm" should read --kg/$cm^2$--.

COLUMN 40

Line 12, "contain" should read --contains--;
Line 19, "contain" should read --contains--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 41

Line 39, " $-\underset{\underset{CH_3}{|}}{Si}-(OCH_3)_3$, " should read

-- $-\underset{\underset{CH_3}{|}}{Si}-(OCH_3)_2$, --.

COLUMN 43

Line 5, "contain" should read --contains--;
Line 11, "contain" should read --contains--.

COLUMN 44

Line 17, " $\overset{H}{-N-}$ " should read -- $\overset{\overset{H}{|}}{-N-}$ --;

Line 22, " $\overset{H}{-N-}$ " should read -- $\overset{\overset{H}{|}}{-N-}$ --;

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 44

Line 25, " $-\overset{H}{N}-$ " should read -- $-\overset{\overset{H}{|}}{N}-$ --;

Line 28, " $-\overset{H}{N}-$ " should read -- $-\overset{\overset{H}{|}}{N}-$ --;

Line 29, " $-\underset{\underset{CH_3}{|}}{Si}-(OCH_3)_3$, " should read

-- $-\underset{\underset{CH_3}{|}}{Si}-(OCH_3)_3$, --.

COLUMN 47

Line 39, "image-hearing" should read --image-bearing--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 49

Line 4, "—(OCH)$_3$," should read --—(OCH$_3$)$_3$,--;

Line 16, " $-Si-(OCH_3)_3$, $CH_3$ " should read

-- $-Si-(OCH_3)_2$, $CH_3$ --.

COLUMN 51

Line 43 "image-hearing" should read --image-bearing--.

UNITED STATES PATENT AND TRADEMARK OFFICE

CERTIFICATE OF CORRECTION

PATENT NO. : 5,795,693

DATED : August 18, 1998

INVENTOR(S): KENJI OKADO ET AL.

It is certified that error appears in the above-identified patent and that said Letters Patent is hereby corrected as shown below:

COLUMN 53

Line 16, " $-\underset{\underset{CH_3}{|}}{Si}-(OCH_3)_3$, " should read

-- $-\underset{\underset{CH_3}{|}}{Si}-(OCH_3)_2$, --.

Signed and Sealed this

First Day of June, 1999

*Attest:*

Q. TODD DICKINSON

*Attesting Officer*

*Acting Commissioner of Patents and Trademarks*